US010325741B2

(12) United States Patent
Liang et al.

(10) Patent No.: US 10,325,741 B2
(45) Date of Patent: Jun. 18, 2019

(54) ELECTROMAGNETIC RELAY

(71) Applicant: FUJITSU COMPONENT LIMITED, Tokyo (JP)

(72) Inventors: Chuqi Liang, Tokyo (JP); Masahiro Kaneko, Tokyo (JP); Nobuo Yatsu, Tokyo (JP); Yayoi Tokuhara, Tokyo (JP); Kohei Takahashi, Tokyo (JP); Katsuaki Koshimura, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/409,632

(22) Filed: Jan. 19, 2017

(65) Prior Publication Data

US 2017/0229270 A1 Aug. 10, 2017

(30) Foreign Application Priority Data

Feb. 4, 2016 (JP) ..... 2016-020160

(51) Int. Cl.

| | |
|---|---|
| ***H01H 13/04*** | (2006.01) |
| ***H01H 50/04*** | (2006.01) |
| *H01H 50/14* | (2006.01) |
| *H01H 9/02* | (2006.01) |

(52) U.S. Cl.

CPC ..... *H01H 50/047* (2013.01); *H01H 50/14* (2013.01); *H01H 2009/0278* (2013.01)

(58) Field of Classification Search

CPC ..... H01H 50/047; H01H 50/14
USPC ..... 335/202
See application file for complete search history.

(56) References Cited

U.S. PATENT DOCUMENTS

| | | | | |
|---|---|---|---|---|
| 3,242,296 | A * | 3/1966 | Woolley | H01H 1/14 200/275 |
| 3,337,826 | A * | 8/1967 | Lehmann | H01H 50/76 335/90 |
| 5,949,313 | A * | 9/1999 | Aoki | H01H 50/305 335/133 |
| 2014/0240065 | A1* | 8/2014 | Sakai | H01H 51/06 335/187 |
| 2016/0027599 | A1* | 1/2016 | Kawamura | H01R 13/113 335/202 |

FOREIGN PATENT DOCUMENTS

| | | |
|---|---|---|
| JP | 3-12198 | 8/1987 |
| JP | 10-27533 | 1/1998 |
| JP | 2012-142210 | 7/2012 |

OTHER PUBLICATIONS

J-Plat Pat English abstract, Publication No. 2012-142210 published Jul. 26, 2012.
J-Plat Pat English abstract, Publication No. 10-27533 published Jan. 27, 1998.

* cited by examiner

*Primary Examiner* — Shawki S Ismail
*Assistant Examiner* — Lisa Homza
(74) *Attorney, Agent, or Firm* — Staas & Halsey LLP

(57) ABSTRACT

An electromagnetic relay including: a relay body that includes a first terminal; a base that includes a second terminal which contacts the first terminal and supports the relay body; an outer cover that covers the relay body; and an elastic member that is attached between the relay body and the outer cover.

7 Claims, 28 Drawing Sheets

ELECTROMAGNETIC RELAY

CROSS-REFERENCE TO RELATED APPLICATION

This application is based upon and claims the benefit of priority of the prior Japanese Patent Application No. 2016-020160 filed on Feb. 4, 2016, the entire contents of which are incorporated herein by reference.

FIELD

A certain aspect of the embodiments is related to an electromagnetic relay.

BACKGROUND

When the vibration (e.g. vibration generated at the time of opening and closing of a contact) of an electromagnetic relay (hereinafter referred to as "a relay") propagates to the outside, it causes a noise. There has been known a relay in which a spring member is arranged between a relay body and a plug terminal and the spring member elastically supports the relay body, in order to restrict the propagation of the vibration caused from the relay body toward the plug terminal (e.g. see Japanese Laid-open Patent Publication No. 2012-142210). In the relay, a space is provided between the relay body and an outer cover.

SUMMARY

According to an aspect of the present invention, there is provided an electromagnetic relay including: a relay body that includes a first terminal; a base that includes a second terminal which contacts the first terminal and supports the relay body; an outer cover that covers the relay body; and an elastic member that is attached between the relay body and the outer cover.

The objects and advantages of the invention will be realized and attained by the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

In an electromagnetic relay disclosed in Japanese Laid-open Patent Publication No. 2012-142210, the vibration propagates to a spring member, and hence an effect of the noise reduction is insufficient.

A description will now be given of embodiments according to the present invention with reference to drawings.

Figure 1:
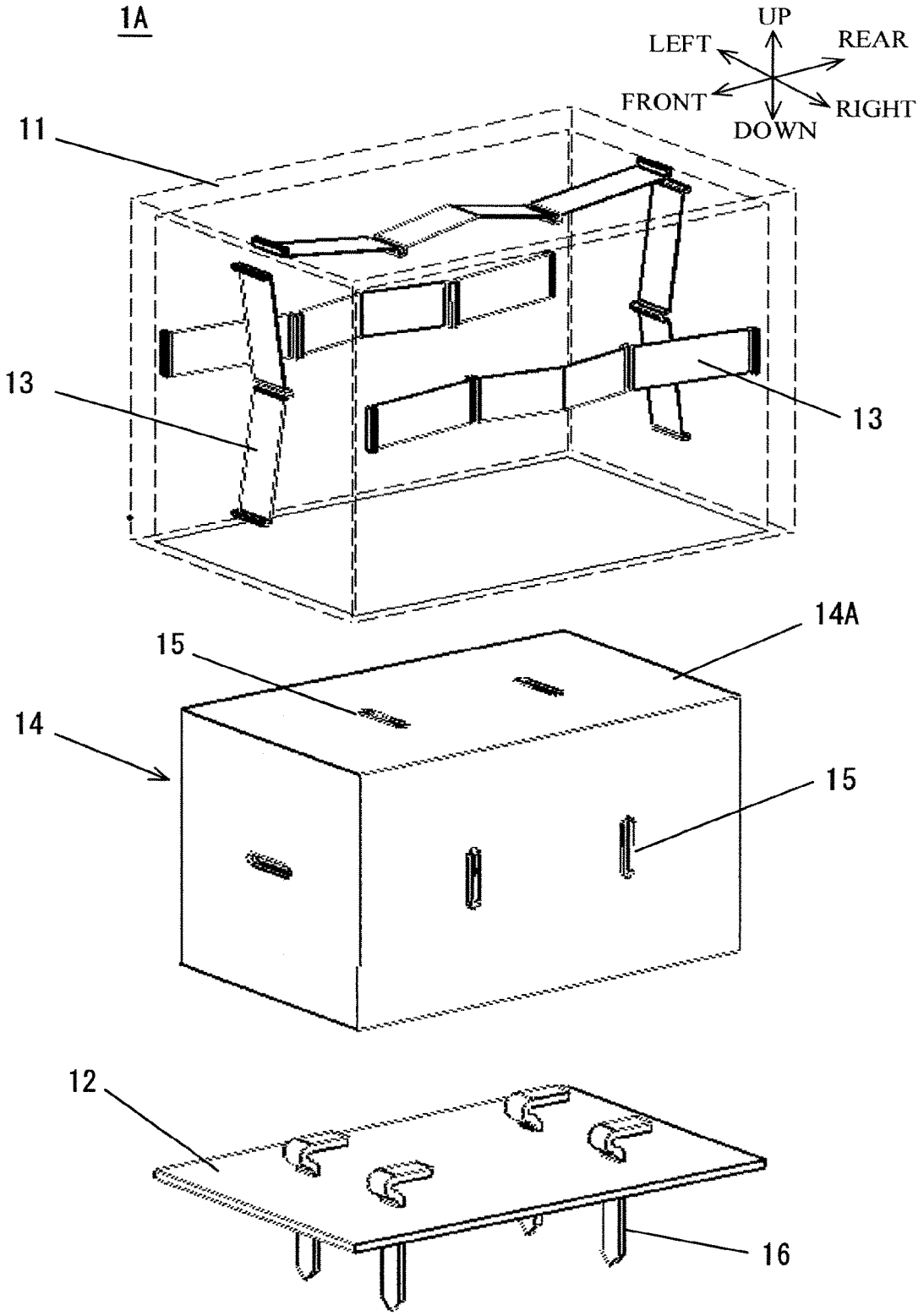
FIG. 1 is an exploded perspective view of an electromagnetic relay according to a first embodiment.
Figure 2:
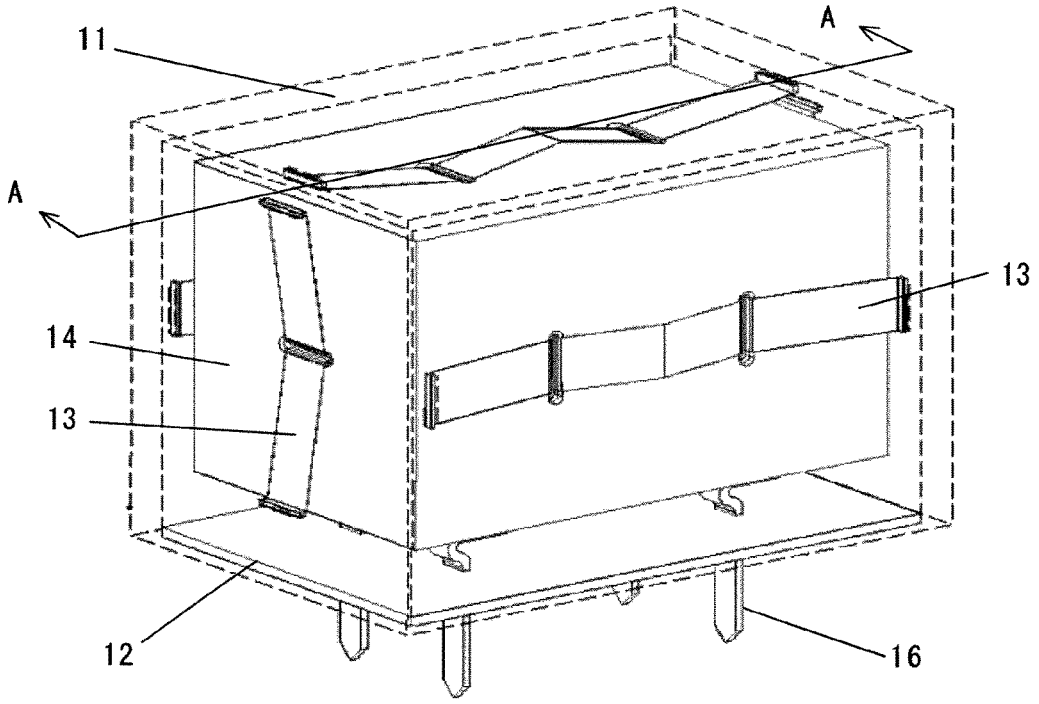
FIG. 2 is a diagram illustrating the assembly structure of the electromagnetic relay.
Figure 3A:
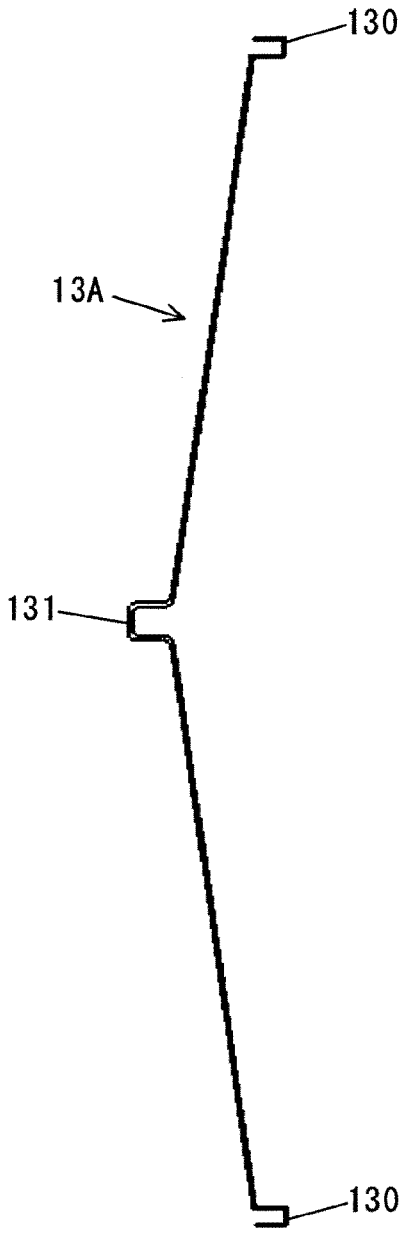
FIGS. 3A and 3B are cross-section diagrams of springs for pressing the electromagnetic relay.
Figure 3B:
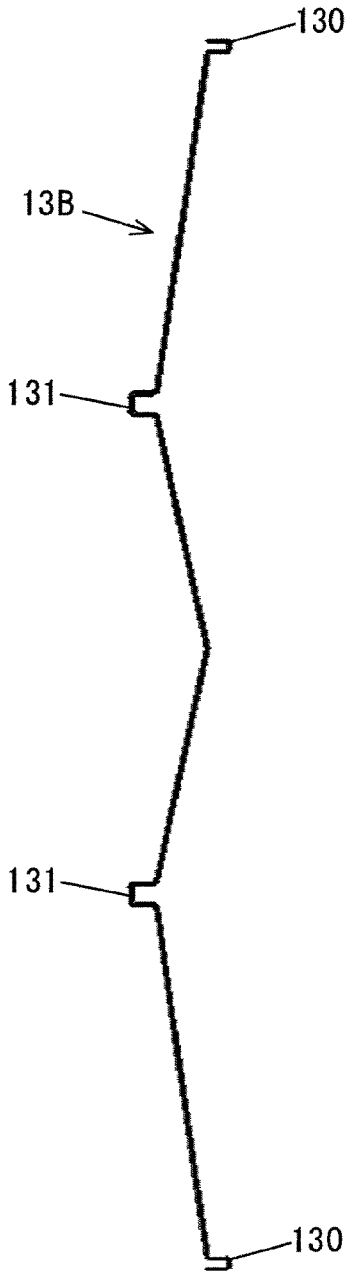
Figure 4:
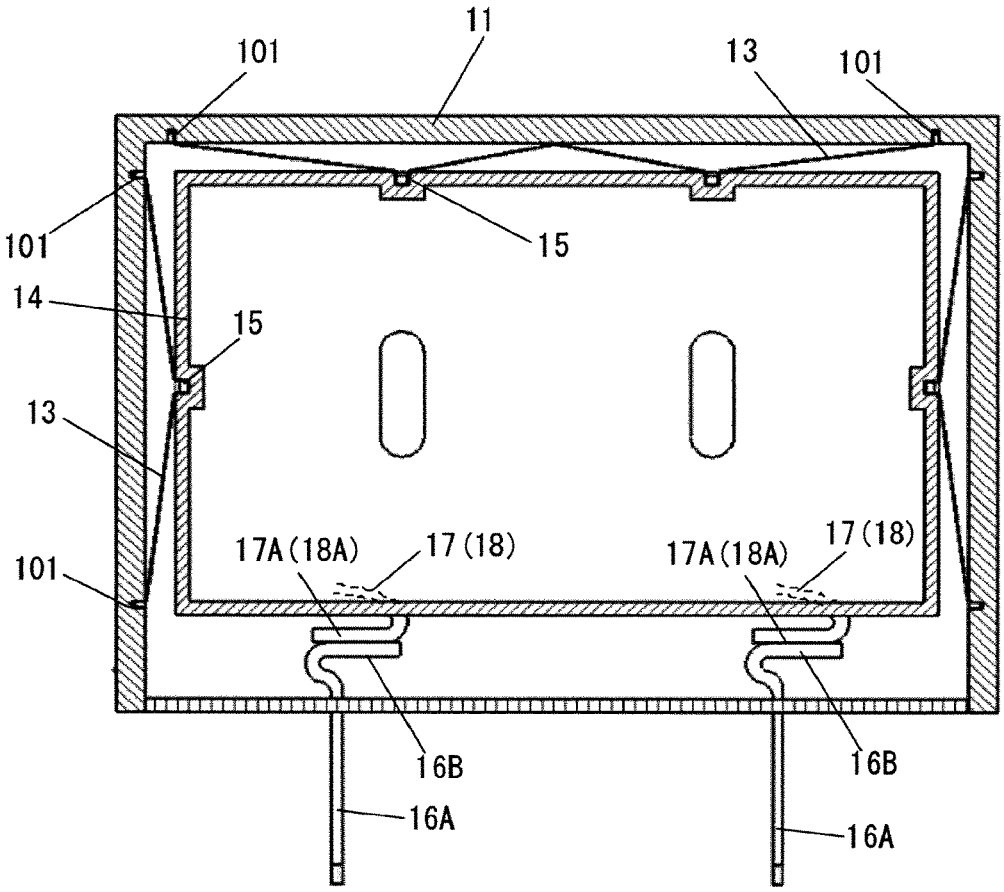
FIG. 4 is a cross-section diagram taken along line A-A in FIG. 2.

(FIRST EMBODIMENT) FIG. 1 is an exploded perspective view of an electromagnetic relay according to a first embodiment. FIG. 2 is a diagram illustrating the assembly structure of the electromagnetic relay. FIGS. 3A and 3B are cross-section diagrams of springs for pressing the electromagnetic relay. FIG. 4 is a cross-section diagram taken along line A-A in FIG. 2. In the following, a front direction, a rear direction, a right direction, a left direction, an up direction, and a down direction are defined as illustrated in FIG. 1 for convenience of explanation.

An electromagnetic relay 1A (hereinafter referred to as "a relay") according to a first embodiment includes an outer cover 11, a relay body 14, a base 12, as illustrated in FIG. 1. That is, the silent type relay 1A is formed by covering the relay body 14 with the outer cover 11 and the base 12. The outer cover 11 and the base 12 constitute an outer case. As illustrated in FIG. 4, grooves 101 as a first groove are formed on an inner wall of the outer cover 11.

The relay body 14 includes an electromagnet not shown, a movable contact not shown, a fixed contact not shown, coil terminals 17 and contact terminals 18 (see FIG. 4). The coil terminals 17 and the contact terminals 18 serve as a first terminal. The relay body 14 may be a so-called hinge type relay or a plunger type relay. As illustrated in FIG. 1, grooves 15 as a second groove are formed on a housing 14A of the relay body 14.

The coil terminals 17 and the contact terminals 18 are bent, and include flat portions 17A and 18A (an example of a first flat portion) in parallel with a bottom surface of the housing 14A of the relay body 14, as illustrated in FIG. 4. The flat portions 17A and 18A are provided outside the housing 14A of the relay body 14.

The base 12 includes external terminals 16 as a second terminal supporting the relay body 14. Each of the external terminals 16 includes a leg portion 16A that is connected to an external device, not shown, and extends perpendicularly from the base 12, and a flat portion 16B (an example of a second flat portion) that is bent from an upper end of the leg portion 16A, and is in parallel with an upper surface of the base 12 or the bottom surface of the housing 14A of the relay body 14. The flat portion 16B comes into surface contact with the flat portions 17A and 18A in assembling, as illustrated in FIG. 4. In the example of FIGS. 1 and 4, there are four external terminals 16, two coil terminals 17 and two contact terminals 18. The number of external terminals 16, coil terminals 17 and contact terminals 18 does not have limitation.

In FIG. 1, the outer cover 11 is transparent. Elastic members, plate springs 13 in FIG. 1, are attached to the inner wall of the outer cover 11. The plate springs 13 include a plate spring 13A and a plate spring 13B which have an uneven cross section, as illustrated in FIGS. 3A and 3B. Specifically, the plate spring 13A has a substantially V-shaped cross section, and the plate spring 13B has a substantially W-shaped cross section.

First engaging portions 130 that engage with the grooves 101 formed on the inner wall of the outer cover 11 are formed on both ends of the plate springs 13A and 13B. Moreover, second engaging portions 131 that engage with the grooves 15 formed on the housing 14A are formed on a center of the plate spring 13A and two tops of the plate spring 13B which are a middle portion of the plate spring 13 and contact with the housing 14A of the relay body 14.

When the outer cover 11 to which the plate springs 13A and 13B are attached covers the relay body 14 arranged on the base 12, the second engaging portions 131 of the plate springs 13A and 13B engage with the grooves 15 formed on the housing 14A of the relay body 14, and hence the position of the relay body 14 is fixed. Here, the outer cover 11 is fixed on the base 12 with an adhesive. Moreover, the base 12 may be fixed to the outer cover 11 by press fit.

A force of the plate springs 13A and 13B for pressing the relay body 14, which is generated by the second engaging portions 131 contacting the housing 14A, presses the flat portions 17A and 18A against the flat portions 16B. At this time, a vibration generated in the relay body 14 is attenuated by a friction generated between the flat portions 17A and 18A and the flat portions 16B, and it is restrained to propagate the vibration to the outside of the relay.

In the first embodiment, the plate springs 13 arc provided on the front, the rear, the right, the left and the upper sides of the inner wall of the outer cover 11. However, if the vibration generated in the relay body 14 can be restricted, the plate springs 13 may be provided on only a part of the inner wall of the outer cover 11. For example, the plate springs 13B may be provided on only the right and the left sides of the inner wall of the outer cover 11. Alternatively, the plate springs 13B may be provided on only the upper side of the inner wall of the outer cover 11. Alternatively, the plate springs 13A may be provided on only the front and the rear sides of the inner wall of the outer cover 11.

Figure 5:
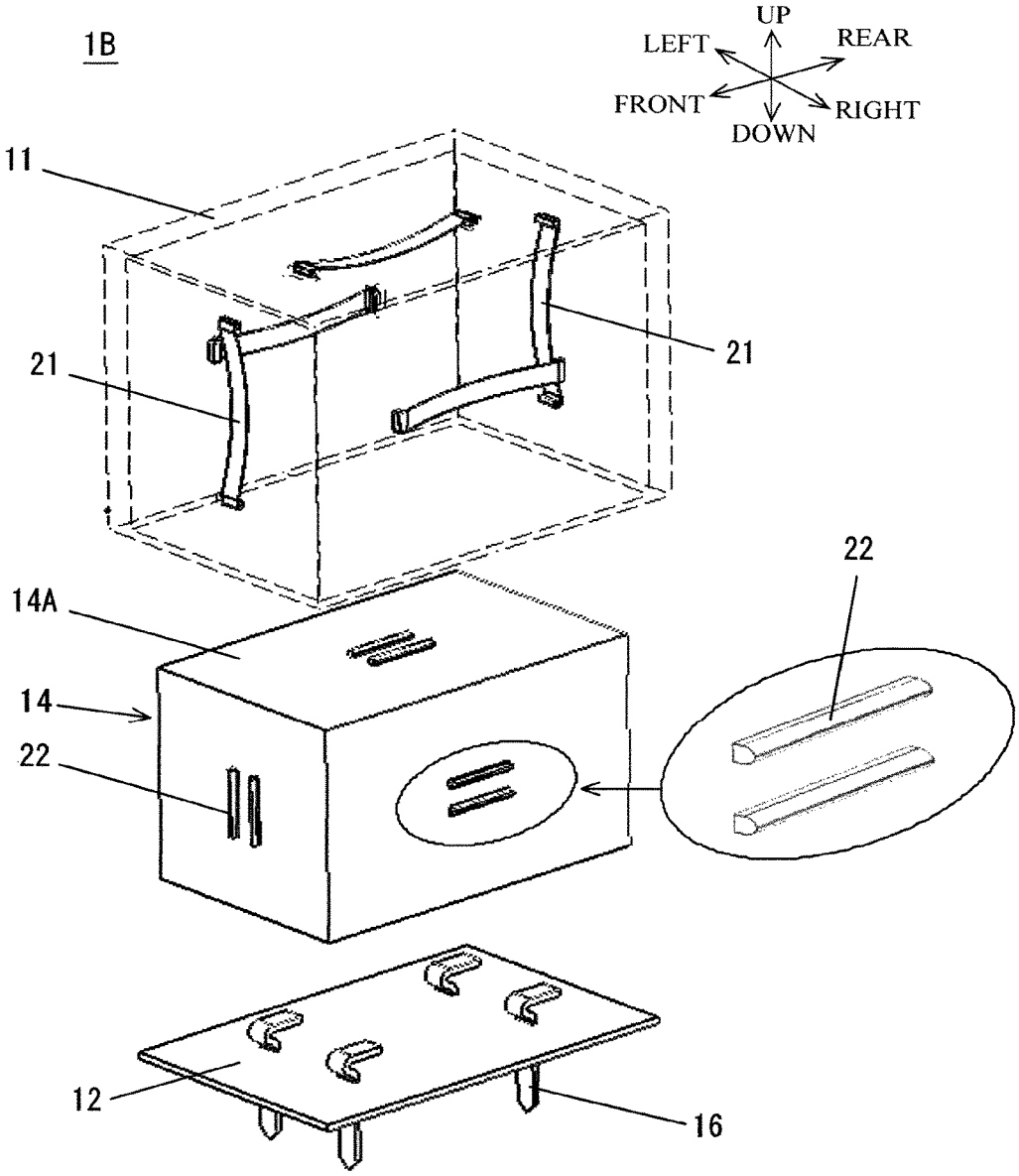
FIG. 5 is an exploded perspective view of an electromagnetic relay according to a second embodiment.
Figure 6:
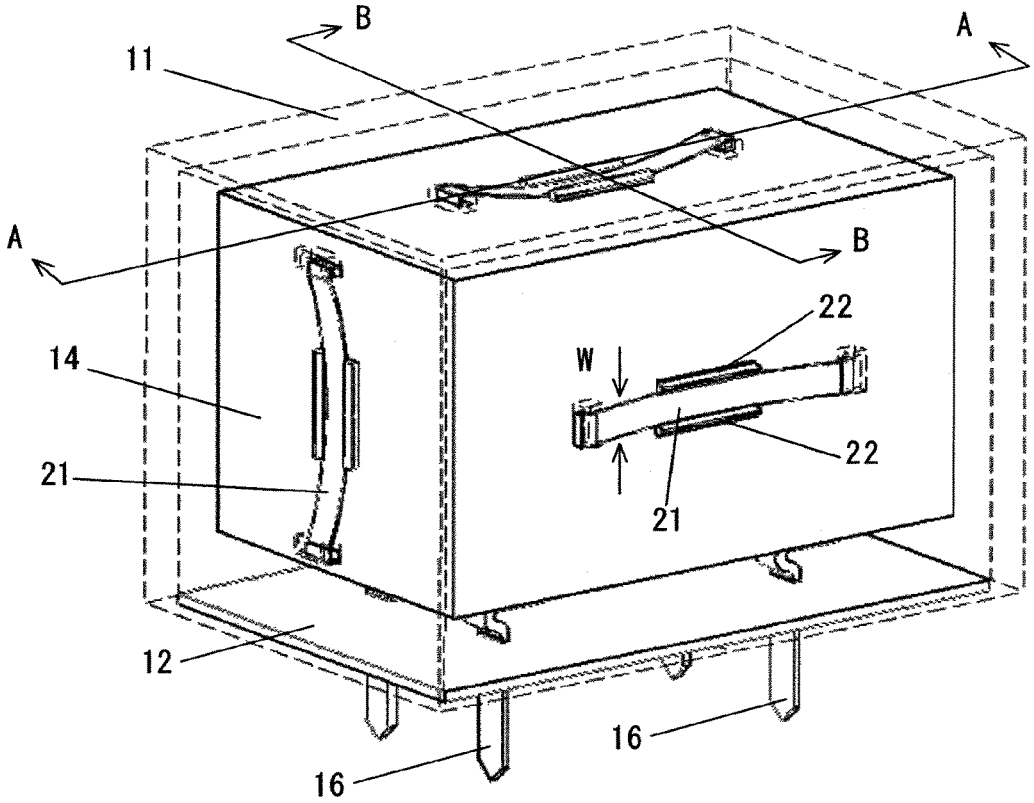
FIG. 6 is a diagram illustrating the assembly structure of the electromagnetic relay.
Figure 7:
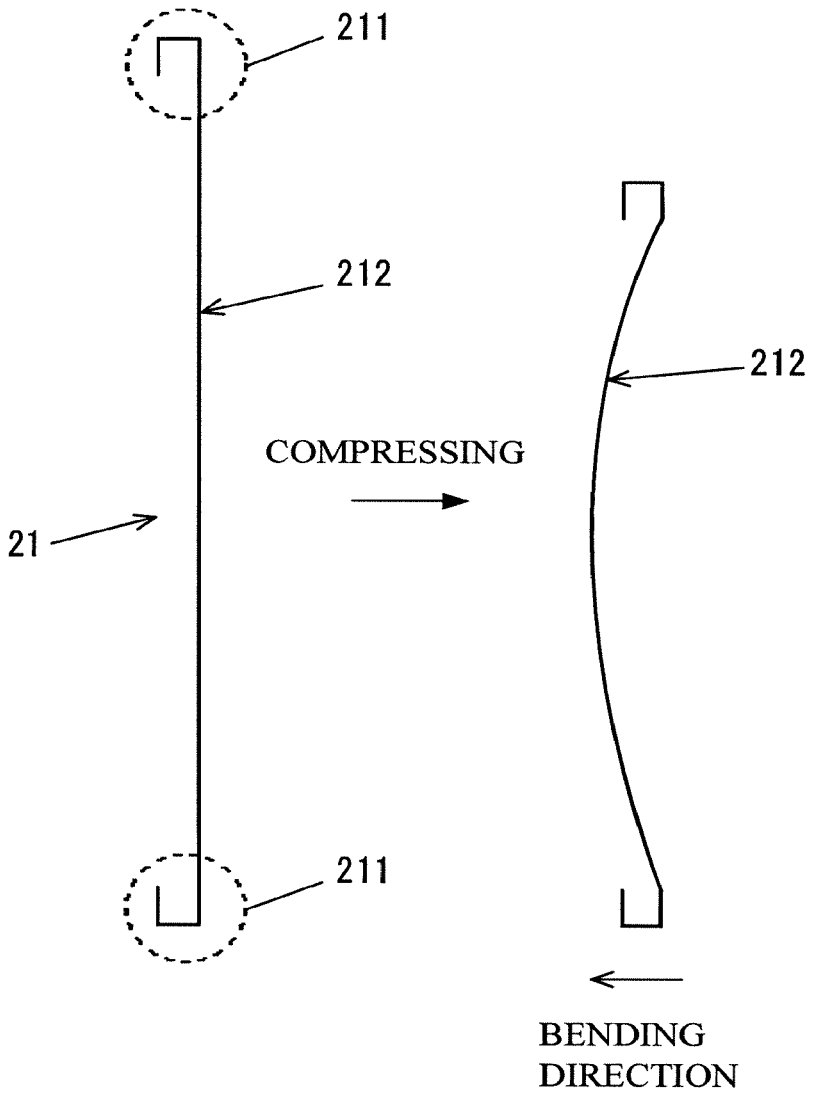
FIG. 7 is a cross-section diagram of a spring for pressing the electromagnetic relay.
Figure 8:
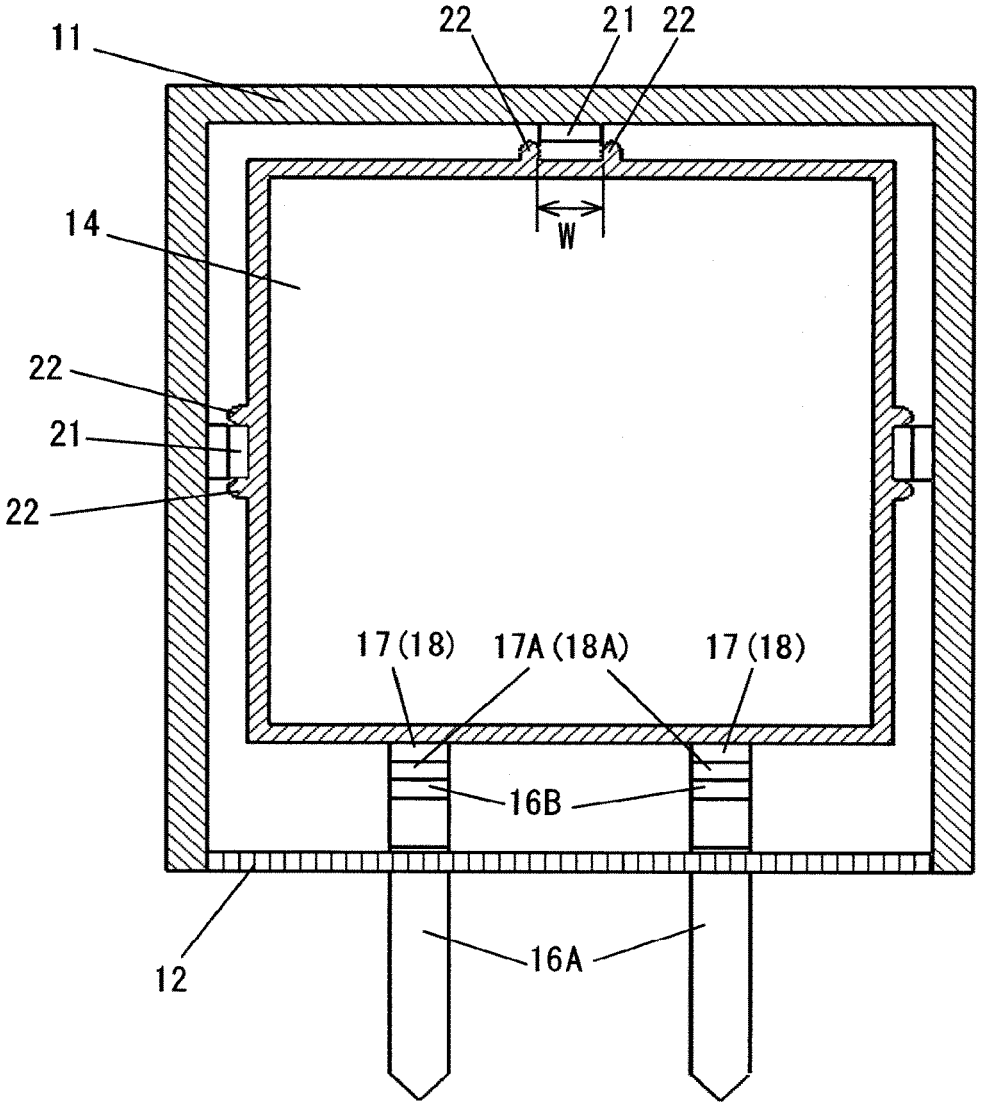
FIG. 8 is a cross-section diagram taken along line B-B in FIG. 6.
Figure 9:
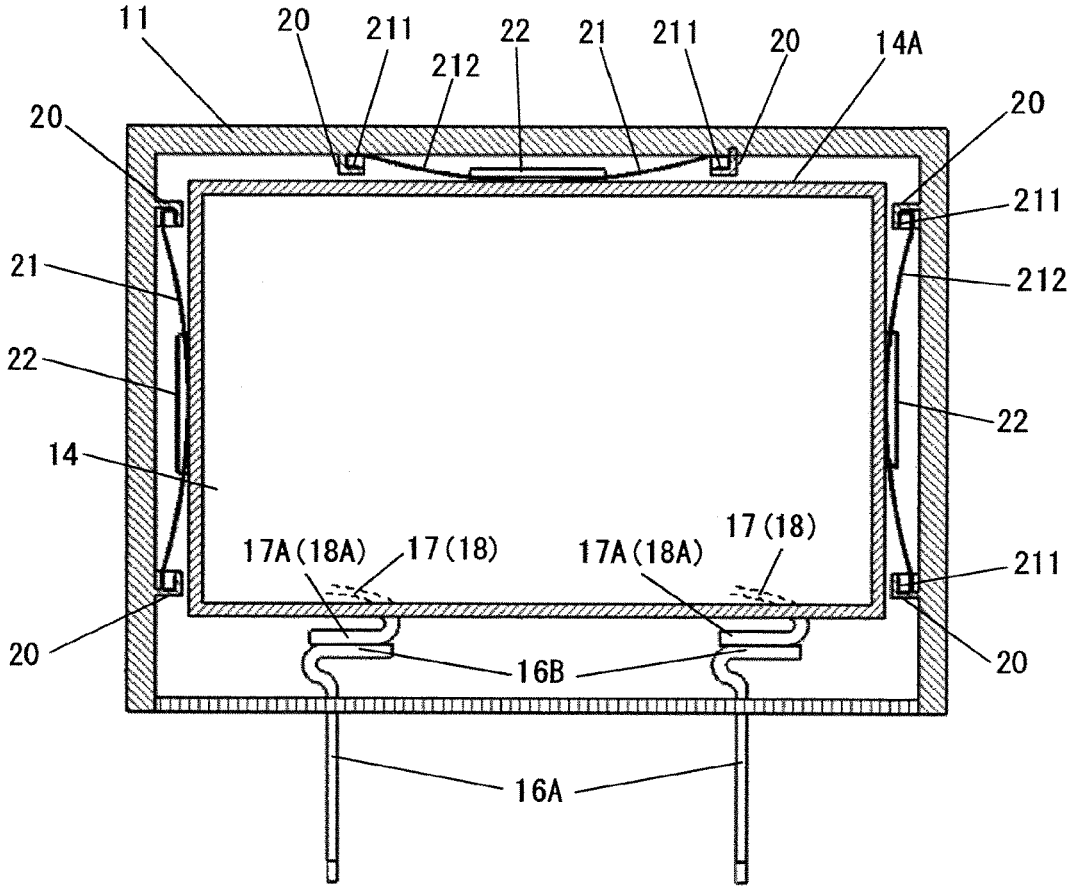
FIG. 9 is a cross-section diagram taken along line A-A in FIG. 6.

(SECOND EMBODIMENT) FIG. 5 is an exploded perspective view of an electromagnetic relay according to a second embodiment. FIG. 6 is a diagram illustrating the assembly structure of the electromagnetic relay. FIG. 7 is a cross-section diagram of a spring for pressing the electromagnetic relay. FIG. 8 is a cross-section diagram taken along line B-B in FIG. 6. FIG. 9 is a cross-section diagram taken along line A-A in FIG. 6. Elements corresponding to those of the first embodiment are designated by identical reference numerals, and a description thereof is omitted. In the following, the front direction, the rear direction, the right direction, the left direction, the up direction, and the down direction are defined as illustrated in FIG. 5 for convenience of explanation.

As illustrated in FIG. 5, a relay 1B according to a second embodiment includes the outer cover 11, the relay body 14 and the base 12. Receiving portions 20 for attaching plate springs 21 are formed on the inner wall of the outer cover 11, as illustrated in FIG. 9. In FIGS. 5 and 6, the receiving portions 20 are omitted.

As illustrated in FIG. 5, two rod-like projections 22 (an example of a fitted portion) extending parallel are formed on each surface (except a bottom surface) of the housing 14A of the relay body 14. An interval between the two projections 22 is the same as a width "w" of the plate spring 21, as illustrated in FIGS. 6 and 8. The plate spring 21 is fitted between the two projections 22.

In FIGS. 5 and 6, the outer cover 11 is transparent. The plate springs 21, an example of an elastic member, are attached to the inner wall of the outer cover 11. Moreover, bending portions 211 to be fitted into the receiving portions 20 formed on the inner wall of the outer cover 11 are formed on both ends of each plate spring 21, as illustrated in FIG. 7. A flat portion 212, as a third flat portion, is formed on the center of the plate spring 21. When the plate spring 21 is attached to the receiving portions 20 and the plate spring 21 is compressed as illustrated in FIG. 7, the flat portion 212 curves in a bending direction of the bending portions 211 illustrated in FIG. 7, and the plate spring 21 curves so as to contact the housing 14A of the relay body 14 illustrated in FIG. 9. A part of the curved flat portion 212 is fitted between the projections 22, as illustrated in FIGS. 8 and 9. When the outer cover 11 in which the plate spring 21 is fitted into the receiving portions 20 covers the relay body 14 arranged on the base 12, the part of the flat portion 212 of the plate spring 21 is fitted between the projections 22 formed on the housing 14A of the relay body 14, and the position of the relay body 14 is fixed. Here, the outer cover 11 is fixed to the base 12 with an adhesive. Moreover, the base 12 may be fixed to the outer cover 11 by press fit.

A force of the plate springs 21 for pressing the relay body 14, which is generated by contacting the housing 14A, presses the flat portions 17A and 18A against the flat portions 16B. At this time, a vibration generated in the relay body 14 is attenuated by a friction generated between the flat portions 17A and 18A and the flat portions 16B, and it is restrained to propagate the vibration to the outside of the relay.

In the second embodiment, the plate springs 21 are provided on each inner wall of the outer cover 11. However, the plate springs 21 may be provided on only a part of the inner wall of the outer cover 11. For example, the plate springs 21 may be provided on only the front and rear sides of the inner wall of the outer cover 11. Alternatively, the plate springs 21 may be provided on only the right and left sides of the inner wall of the outer cover 11. Alternatively, the plate springs 21 may be provided on only the upper side of the inner wall of the outer cover 11.

Figure 10:
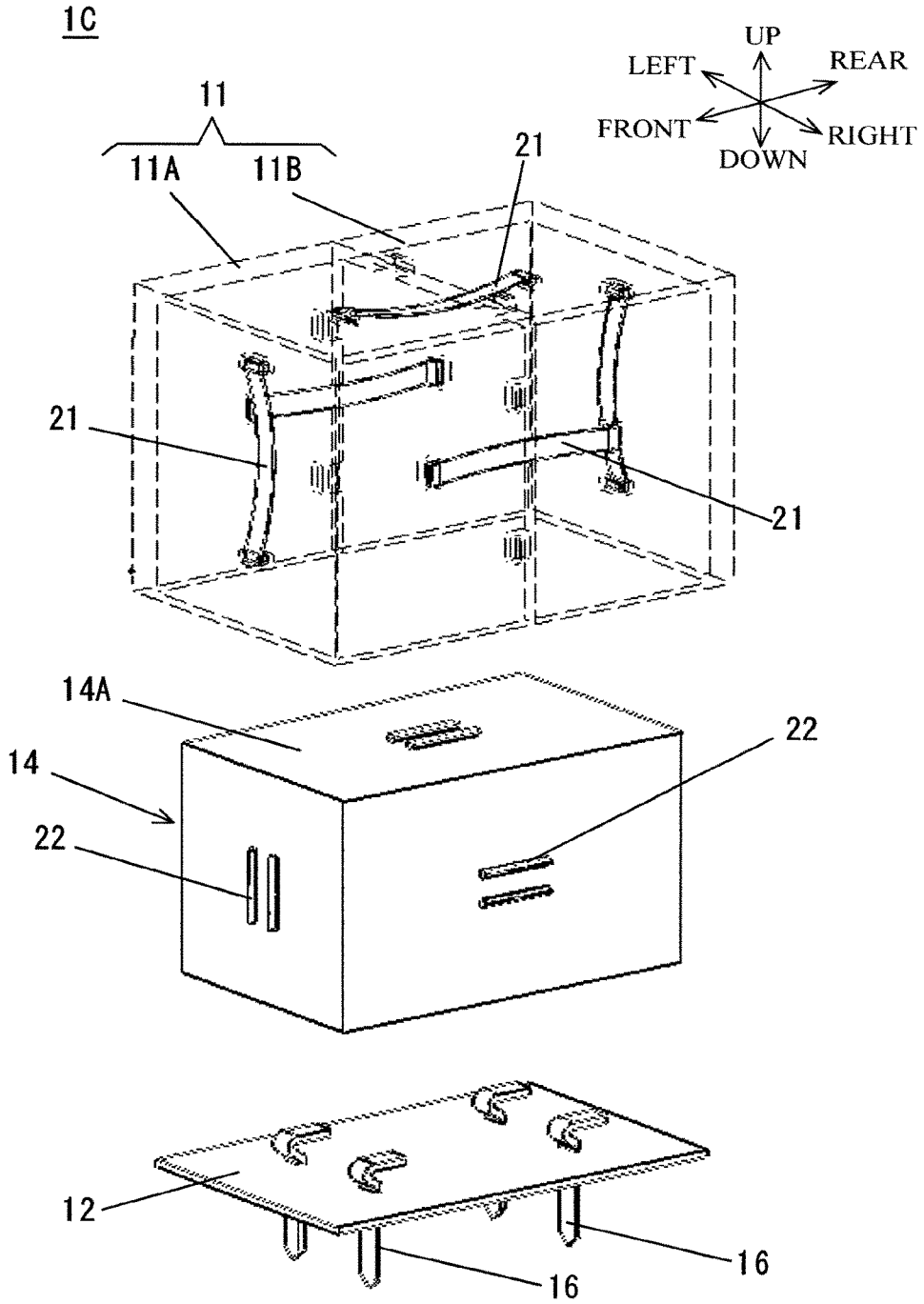
FIG. 10 is an exploded perspective view of an electromagnetic relay according to a third embodiment.
Figure 11:
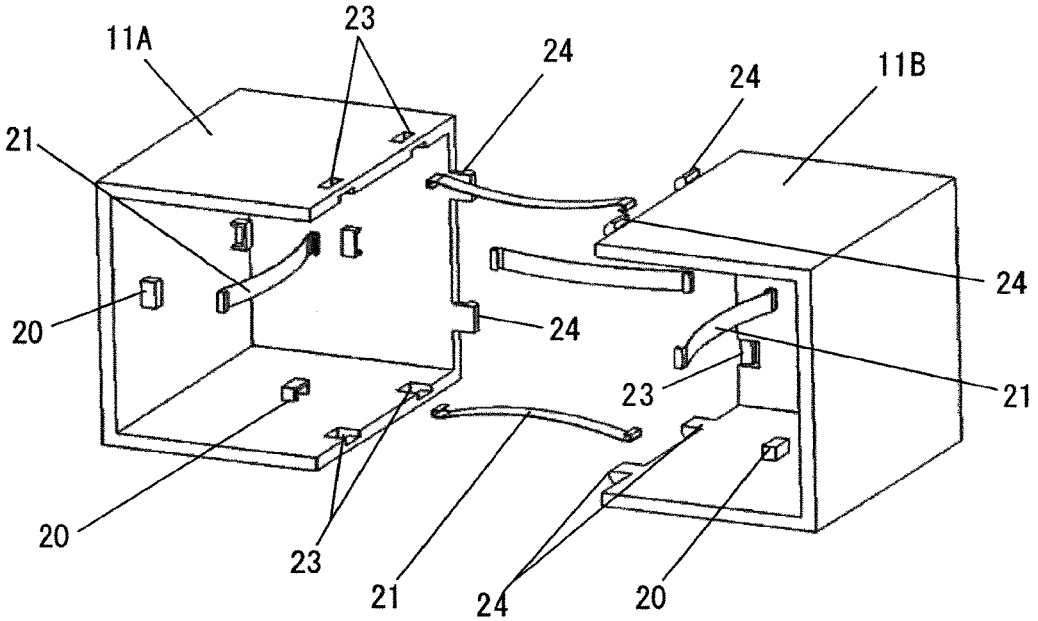
FIG. 11 is a diagram illustrating the structure of an outer cover as viewed from below.

(THIRD EMBODIMENT) FIG. 10 is an exploded perspective view of an electromagnetic relay according to a third embodiment. FIG. 11 is a diagram illustrating the structure of the outer cover as viewed from below. Elements corresponding to those of the second embodiment are designated by identical reference numerals, and a description thereof is omitted. In the following, the front direction, the rear direction, the right direction, the left direction, the up direction, and the down direction are defined as illustrated in FIG. 10 for convenience of explanation.

As illustrated in FIG. 10, a relay 1C according to a third embodiment includes the outer cover 11, the relay body 14 and the base 12. The outer cover 11 is divided into a first outer cover 11A and a second outer cover 11B, as illustrated in FIGS. 10 and 11. Here, the outer cover 11 is divided into two, and may be divided into "n (n=3 or more)".

The receiving portions 20 for attaching plate springs 21 are formed on the inner wall of the first outer cover 11A and the second outer cover 11B. Recess portions 23 and claw portions 24 as a third engaging portion are formed on an edge of the first outer cover 11A to be coupled with the second outer cover 11B. Similarly, the recess portions 23 and the claw portions 24 are formed on an edge of the second outer cover 11B to be coupled with the first outer cover 11A. The claw portions 24 of the second outer cover 11B engage with the recess portions 23 of the first outer cover 11A, and the claw portions 24 of the first outer cover 11A engage with the recess portions 23 of the second outer cover 11B. The first outer cover 11A and the second outer cover 11B are coupled with each other so as not to generate a gap by the recess portions 23 and the claw portions 24. In the third embodiment, the outer cover 11 can be divided, and therefore the plate springs 21 are easily attached to the first outer cover 11A and the second outer cover 11B.

In the third embodiment, the plate springs 21 are provided on the inner wall (i.e., the front, the rear, the right, the left and the upper sides of the inner wall) of the first outer cover 11 A and the second outer cover 11B. However, the plate springs 21 need not be provided on all of the inner wall of the first outer cover 11 A and the second outer cover 11B. For example, the plate springs 21 may be provided on only the front and the rear sides of the inner wall of the first outer cover 11A and the second outer cover 11B. Alternatively, the plate springs 21 may be provided on only the right and the left sides of the inner wall of the first outer cover 11A and the second outer cover 11B. Alternatively, the plate springs 21 may be provided on only the upper side of the inner wall of the first outer cover 11A and the second outer cover 11B.

Figure 12:
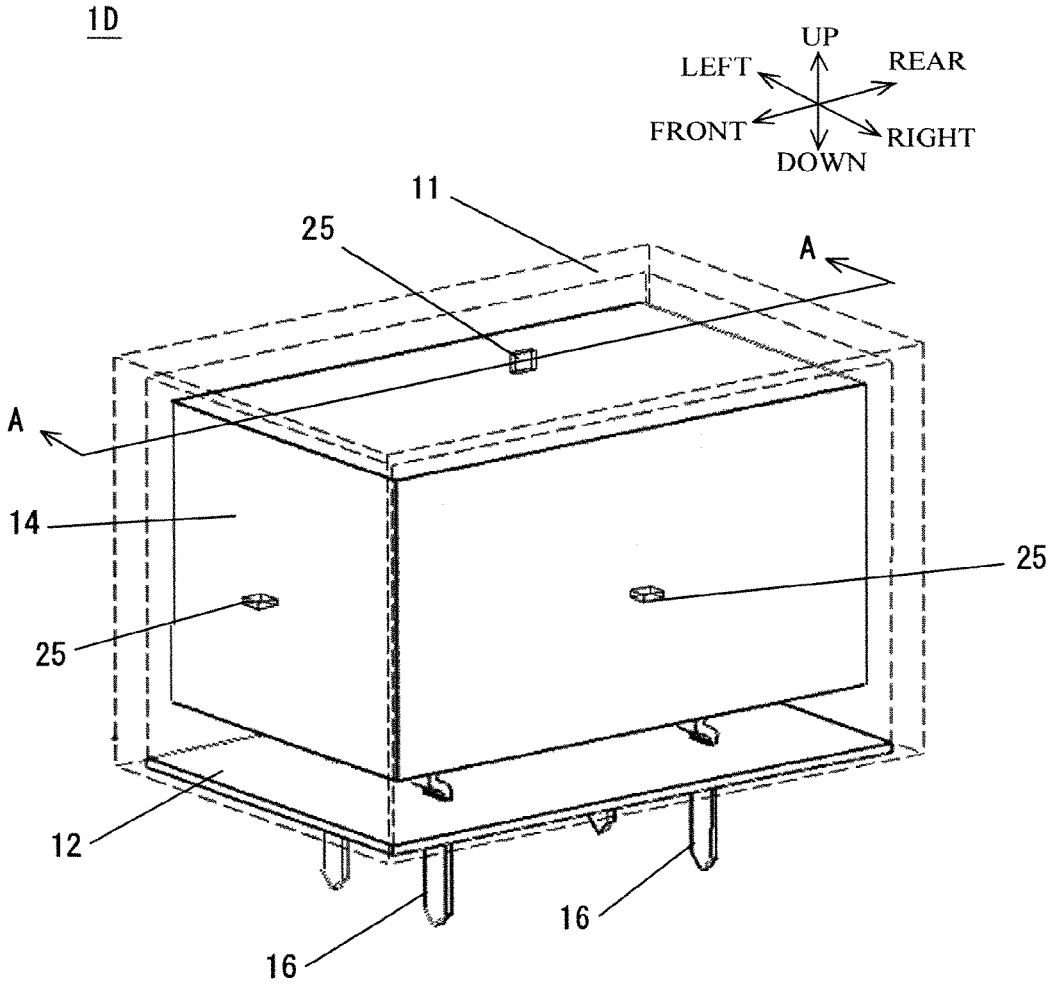
FIG. 12 is a perspective view of an electromagnetic relay according to a fourth embodiment before an elastic member is inserted.
Figure 13:
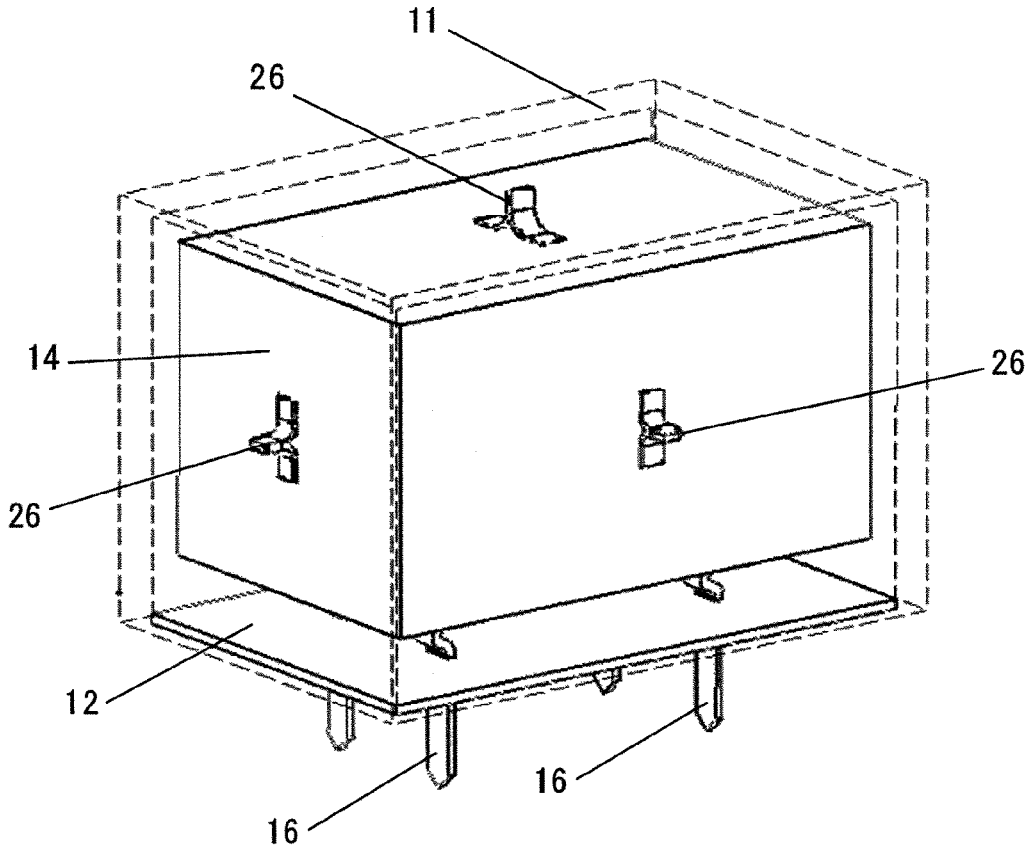
FIG. 13 is a perspective view of the electromagnetic relay according to the fourth embodiment after the elastic member is inserted.
Figure 14A:
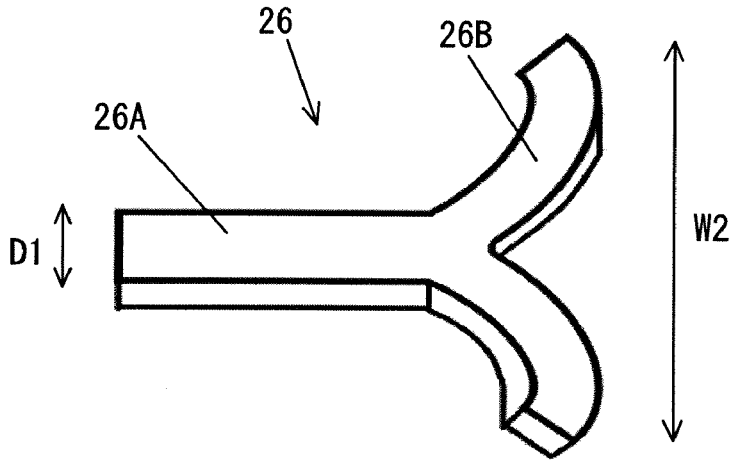
FIG. 14A is a diagram illustrating a shape of the elastic member.
Figure 14B:
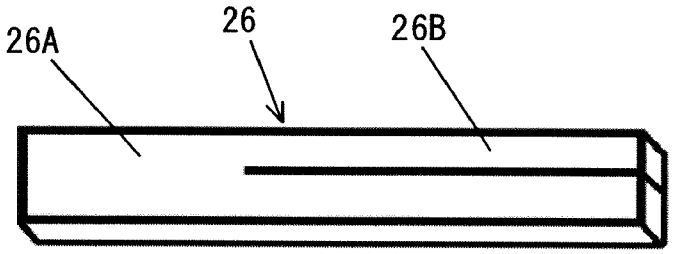
FIG. 14B is a diagram illustrating a shape of the elastic member before insertion.
Figure 15:
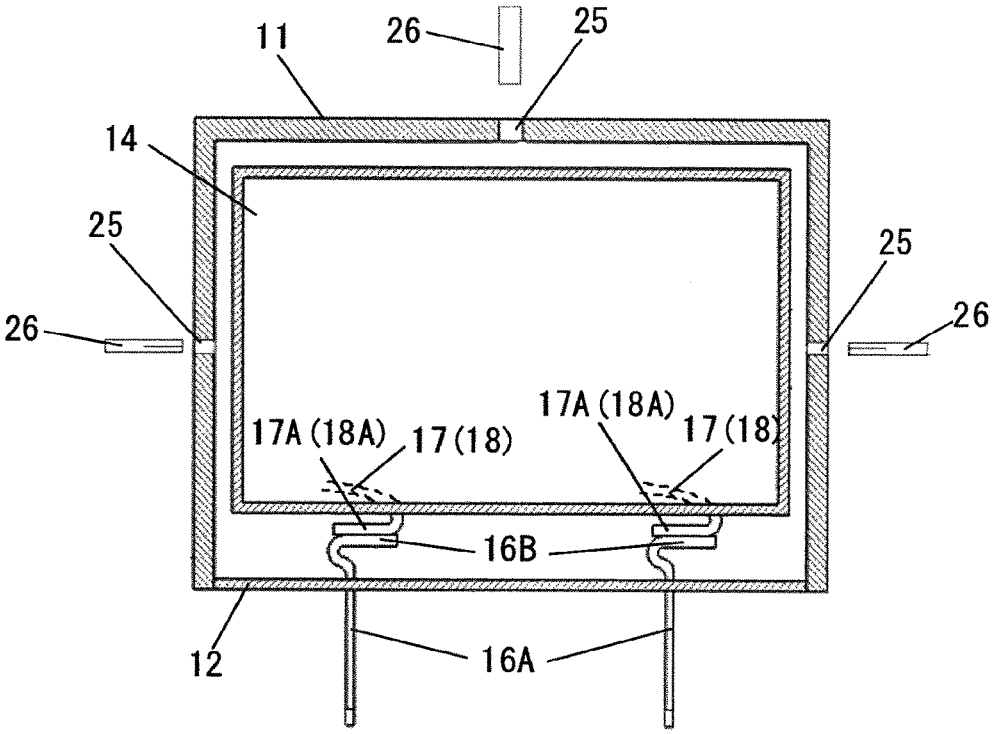
FIG. 15 is a cross-section diagram taken along line A-A in FIG. 12.

(FOURTH EMBODIMENT) FIG. 12 is a perspective view of an electromagnetic relay according to a fourth embodiment before an elastic member is inserted. FIG. 13 is a perspective view of the electromagnetic relay according to the fourth embodiment after the elastic member is inserted. FIG. 14A is a diagram illustrating a shape of the elastic member, and FIG. 14B is a diagram illustrating a shape of the elastic member before insertion. FIG. 15 is a cross-section diagram taken along line A-A in FIG. 12. Elements corresponding to those of the first embodiment are designated by identical reference numerals, and a description thereof is omitted. In the following, the front direction, the rear direction, the right direction, the left direction, the up direction, and the down direction are defined as illustrated in FIG. 12 for convenience of explanation.

As illustrated in FIG. 12, a relay 1D according to a fourth embodiment includes the outer cover 11, the relay body 14 and the base 12.

In FIGS. 12 and 13, the outer cover 11 is transparent. A through-hole 25 for inserting an elastic member 26 is formed on the center of each surface of the outer cover 11. The elastic member 26 is made of a rubber, a spring or the like, and has a Y-shape in a natural state. The elastic member 26 includes a body portion 26A and a forked portion 26B. The dimension D1 of the body portion 26A is smaller than the through-hole 25. Therefore, the body portion 26A can pass the through-hole 25. On the other hand, a width W2 of the forked portion 26B in a widely spread condition is larger than the through-hole 25, as illustrated in FIG. 14A. Therefore, the forked portion 26B in the widely spread condition cannot pass the through-hole 25. To pass the elastic member 26 through the through-hole 25, a force is applied to the forked portion 26B, and the forked portion 26B is temporarily transformed into a rod shape, as illustrated in FIG. 14B. Then, the elastic member 26 is inserted into the through-hole 25. When the forked portion 26B passes through the through-hole 25 and enters in the inside of the outer cover 11, the forked portion 26B spreads naturally as illustrated in FIG. 13 and returns to the shape of FIG. 14A.

When the forked portion 26B of the elastic member 26 inserted into the through-hole 25 returns to an original shape, a force in which the forked portion 26B presses the relay body 14 presses the flat portions 17A and 18A against the flat portions 16B. At this time, it is restrained that a vibration generated in the relay body 14 propagates to the outside of the relay by a friction generated between the flat portions 17A and 18A and the flat portions 16B.

Here, the shape of the elastic member 26 is not limited to the shape of FIG. 14A. For example, the forked portion 26B may be formed on both ends of the elastic member 26.

In the fourth embodiment, the through-hole 25 is formed on the center of each surface of the outer cover 11, and the elastic member 26 is inserted into the through-hole 25. However, the through-hole 25 need not be formed on all surfaces of the outer cover 11, and the elastic members 26 need not be inserted into all through-holes 25 of the outer cover 11. For example, the through-holes 25 may be provided on only the front and the rear surfaces of the outer cover 11. Alternatively, the through-holes 25 may be provided on only the right and the left surfaces of the outer cover 11. Alternatively, the through-hole 25 may be provided on only the upper surface of the outer cover 11. For example, the elastic members 26 may be inserted into only the through-holes 25 of the front and the rear surfaces of the outer cover 11. Alternatively, the elastic members 26 may be inserted into only the through-holes 25 of the right and the left surfaces of the outer cover 11. Alternatively, the elastic member 26 may be inserted into only the through-hole 25 of the upper surface of the outer cover 11.

Figure 16:
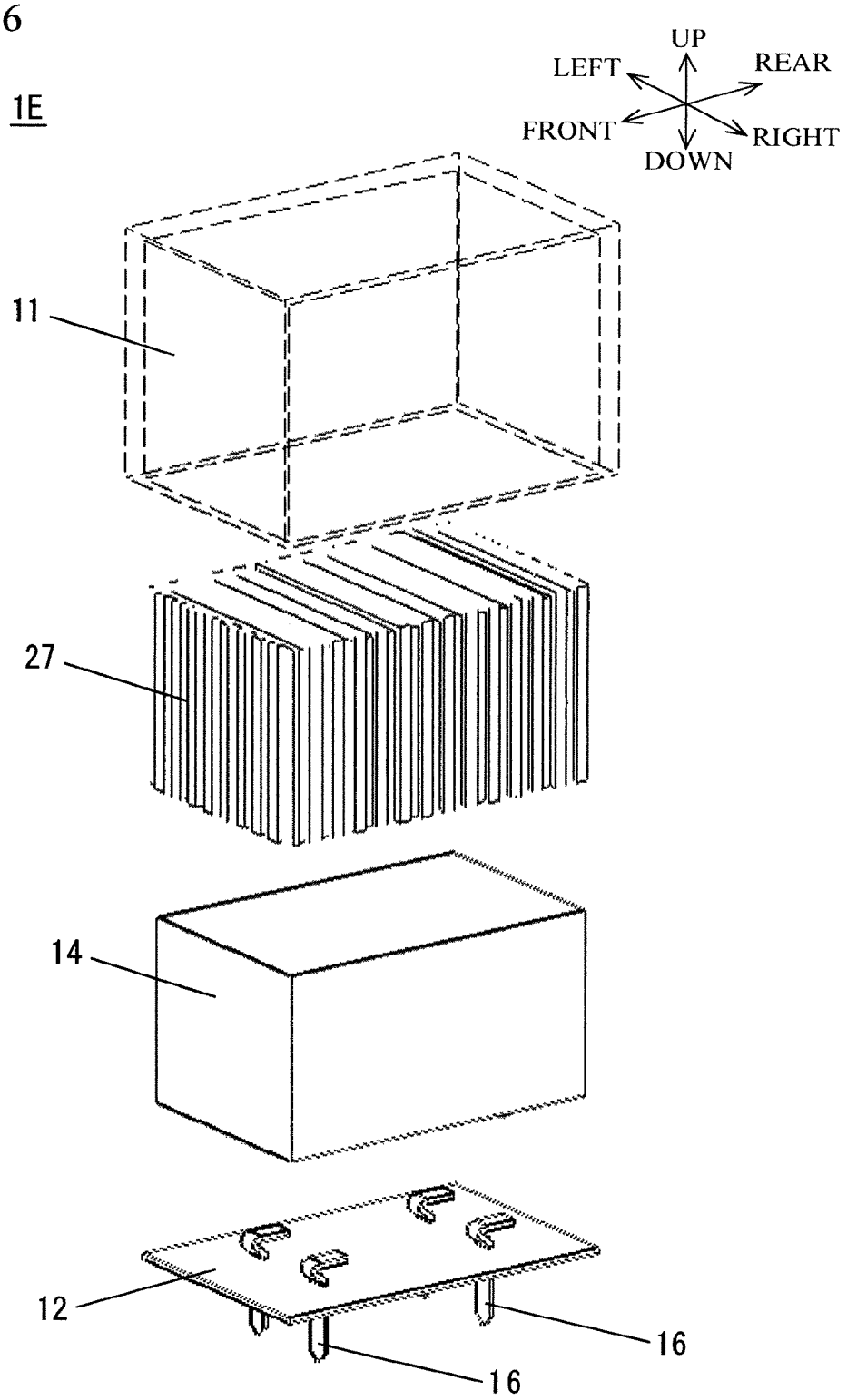
FIG. 16 is an exploded perspective view of an electromagnetic relay according to a fifth embodiment.
Figure 17:
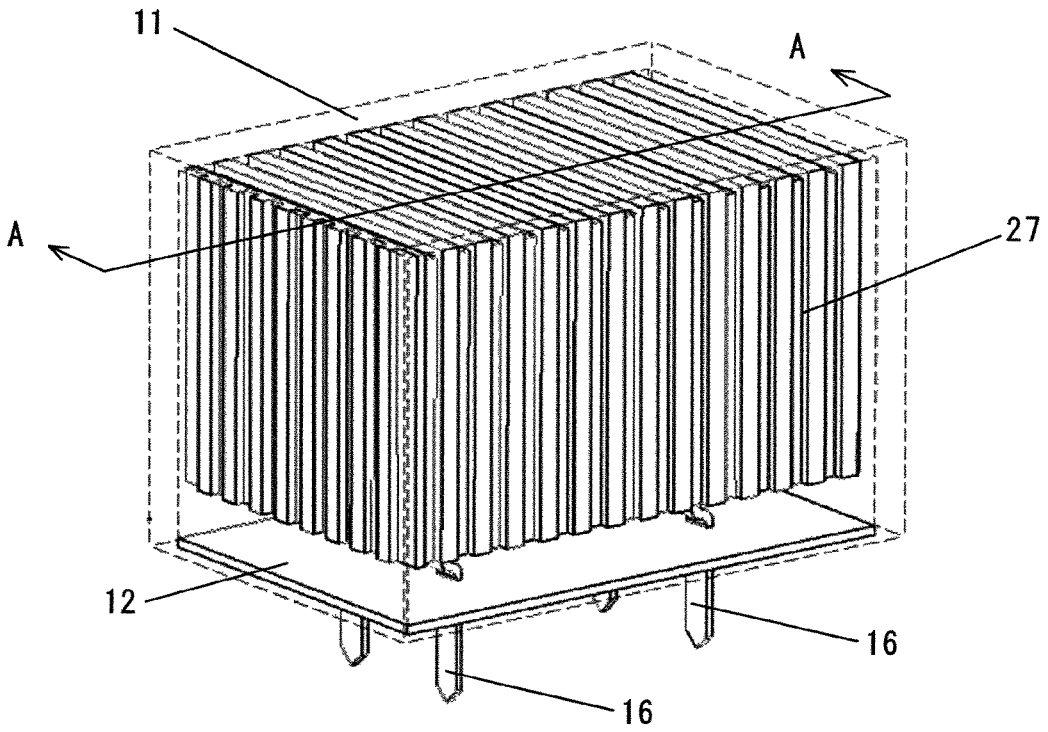
FIG. 17 is a diagram illustrating the assembly structure of the electromagnetic relay.
Figure 18:
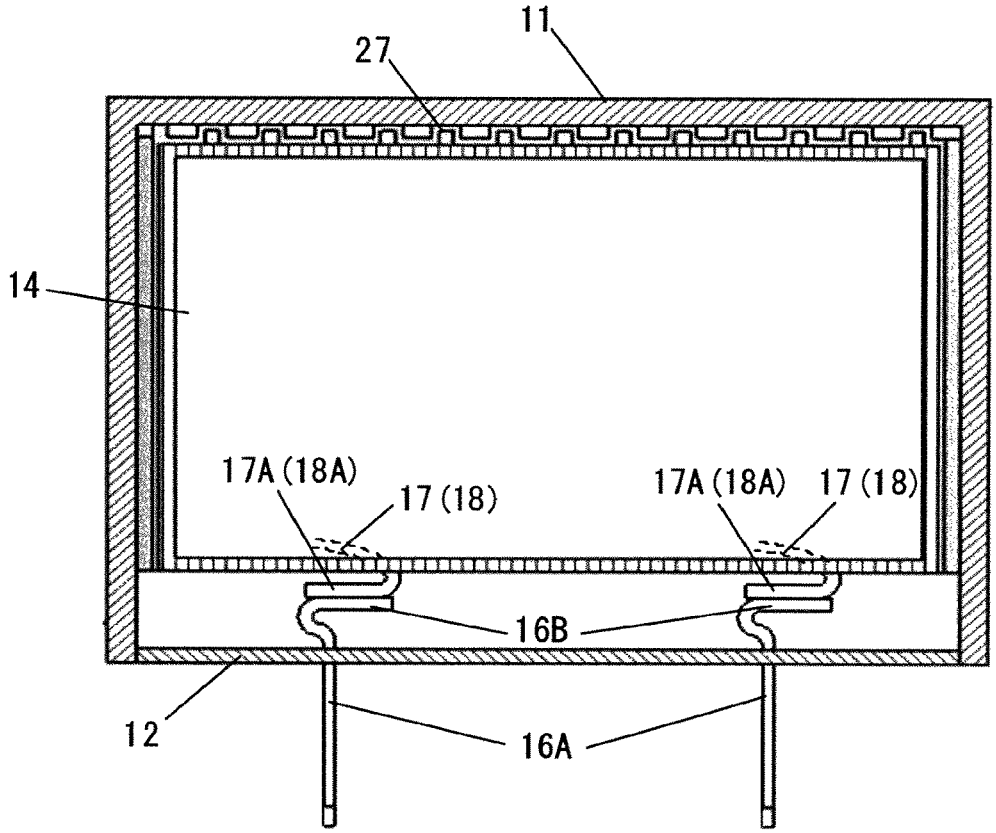
FIG. 18 is a cross-section diagram taken along line A-A in FIG. 17.

(FIFTH EMBODIMENT) FIG. 16 is an exploded perspective view of an electromagnetic relay according to a fifth embodiment. FIG. 17 is a diagram illustrating the assembly structure of the electromagnetic relay. FIG. 18 is a cross-section diagram taken along line A-A in FIG. 17. Elements corresponding to those of the first embodiment are designated by identical reference numerals, and a description thereof is omitted. In the following, the front direction, the rear direction, the right direction, the left direction, the up direction, and the down direction are defined as illustrated in FIG. 16 for convenience of explanation.

As illustrated in FIG. 16, a relay 1E according to a fifth embodiment includes the outer cover 11, the relay body 14, the base 12 and an elastic member 27. The elastic member 27 is made of an elastomer, for example. As illustrated in FIGS. 17 and 18, the elastic member 27 has a case structure without a bottom surface, as with the outer cover 11. The elastic member 27 covers the relay body 14 so as to contact the housing 14A, and contacts the inner cover of the outer cover 11.

When the outer cover 11 covers the relay body 14 to which the elastic member 27 is attached, a force in which the elastic member 27 contacting the housing 14A presses the relay body 14 presses the flat portions 17A and 18A against the flat portions 16B. At this time, it is restrained that the vibration generated in the relay body 14 propagates to the outside of the relay by the friction generated between the flat portions 17A and 18A and the flat portions 16B.

Figure 19:
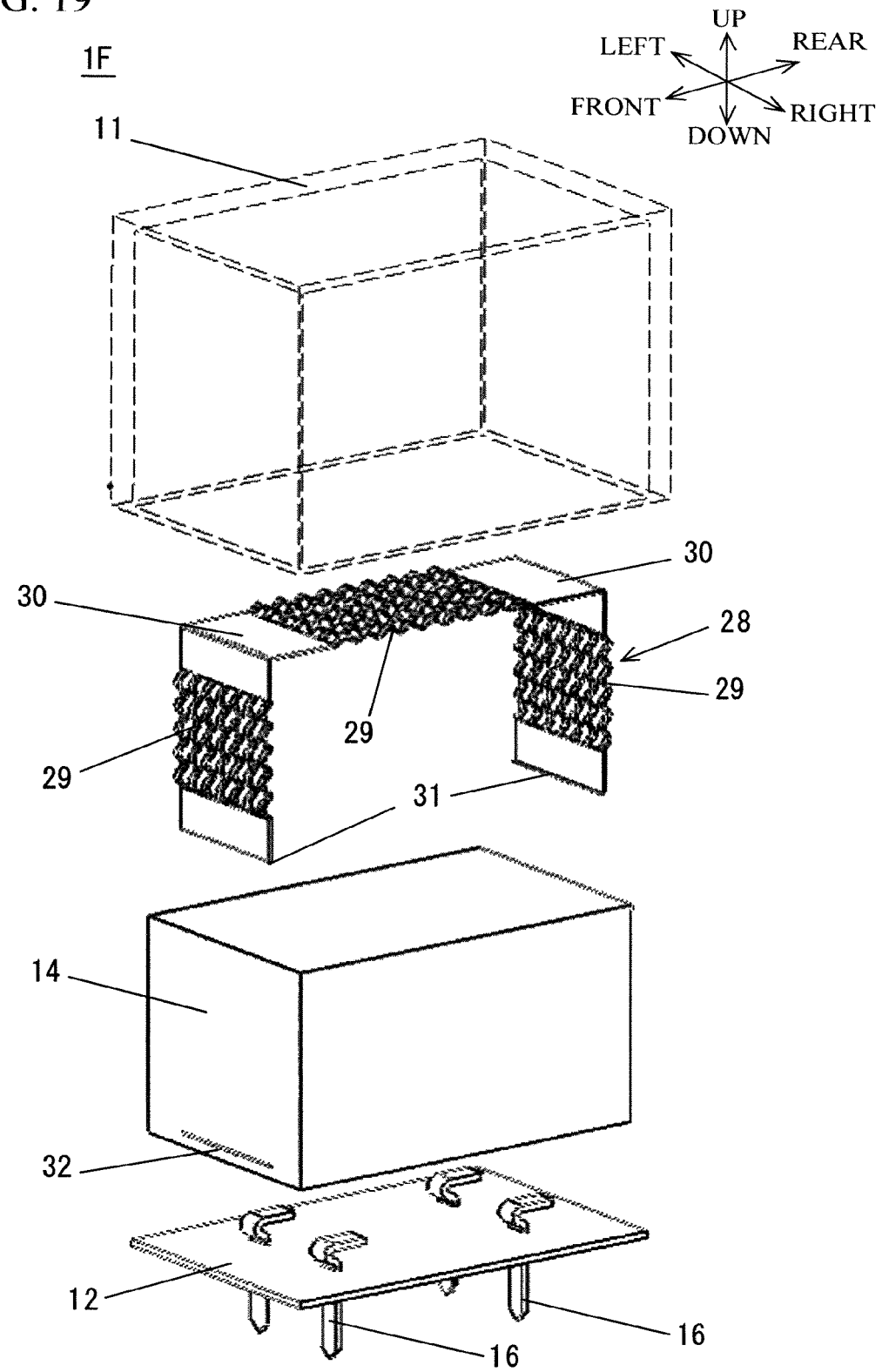
FIG. 19 is an exploded perspective view of an electromagnetic relay according to a sixth embodiment.
Figure 20:
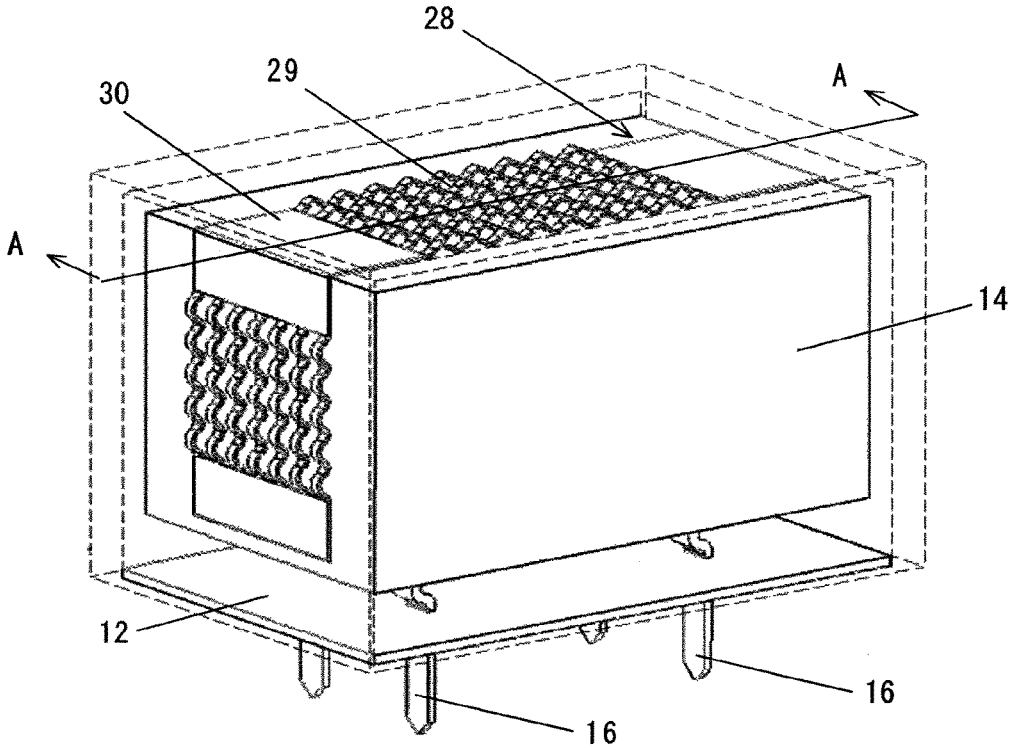
FIG. 20 is a diagram illustrating the assembly structure of the electromagnetic relay.
Figure 21:
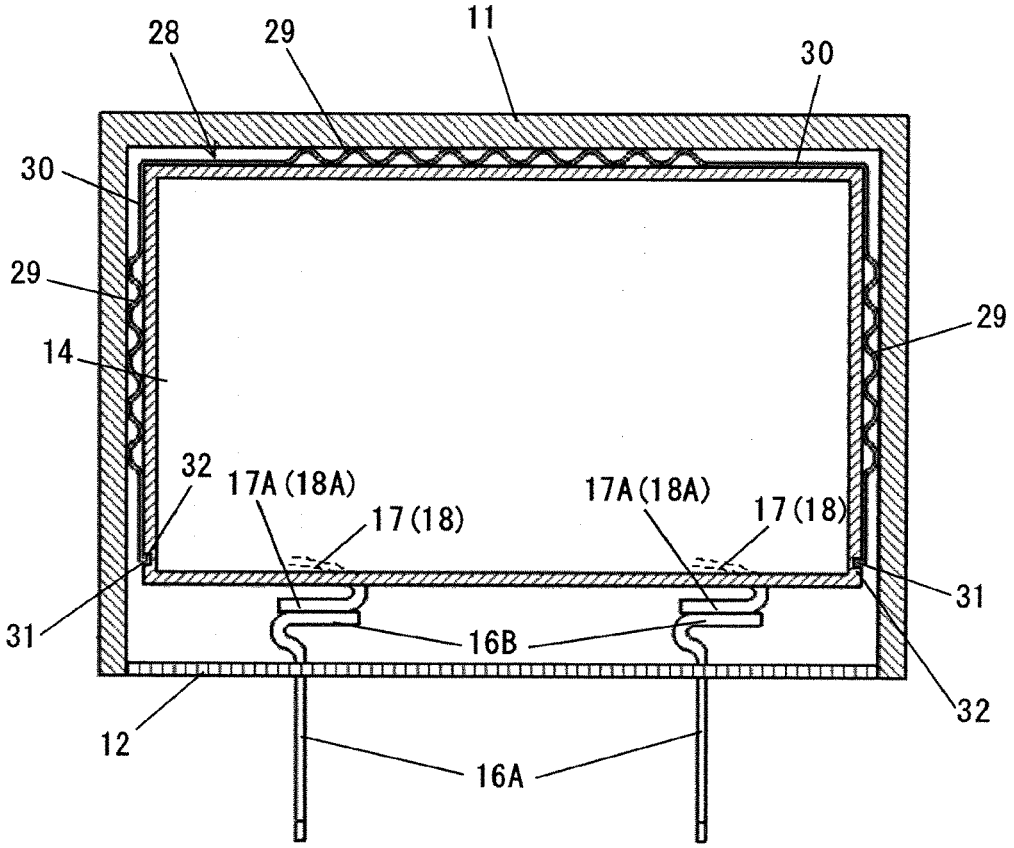
FIG. 21 is a cross-section diagram taken along line A-A in FIG. 20.

(SIXTH EMBODIMENT) FIG. 19 is an exploded perspective view of an electromagnetic relay according to a sixth embodiment. FIG. 20 is a diagram illustrating the assembly structure of the electromagnetic relay. FIG. 21 is a cross-section diagram taken along line A-A in FIG. 20. Elements corresponding to those of the first embodiment are designated by identical reference numerals, and a description thereof is omitted. In the following, the front direction, the rear direction, the right direction, the left direction, the up direction, and the down direction are defined as illustrated in FIG. 19 for convenience of explanation.

As illustrated in FIG. 19, a relay 1F according to a sixth embodiment includes the outer cover 11, the relay body 14, the base 12 and an elastic member 28. The elastic member 28 is a substantially U-shaped plate spring, and is an integrated structure having waveform springs 29 (an example of a waveform portion) and flat springs 30 (an example of fourth portion). As illustrated in FIG. 21, the waveform springs 29 contact the inner wall of the outer cover 11, and the front surface, the rear surface and the upper surface of the relay body 14. The flat springs 30 have plate shapes along the front surface, the rear surface and the upper surface of the relay body 14, and do not contact the inner wall of the outer cover 11. Moreover, formed on both ends of the elastic member 28 are projections 31 that engage with grooves 32 provided on lower ends of the front and the rear surfaces of the relay body 14. The relay body 14 is covered with the elastic member 28 and the projections 31 are fitted in the grooves 32, so that the elastic member 28 can be easily attached to the relay body 14.

Although the grooves 32 are formed on the front surface and the rear surface of the relay body 14, the grooves 32 may be formed on the right surface and the left surface of the relay body 14. Alternatively, the grooves 32 may be formed on all side surfaces of the relay body 14. At this time, an attachment position of the elastic member 28 to the relay body 14 can be changed according to the size of the elastic member 28.

When the outer cover 11 covers the relay body 14 to which the elastic member 28 is attached, as illustrated in FIGS. 20 and 21, each of the waveform springs 29 contacts the outer cover 11 and the housing 14A and a force in which the elastic member 28 presses the relay body 14 presses the flat portions 17A and 18A against the flat portions 16B. At this time, it is restrained that the vibration generated in the relay body 14 propagates to the outside of the relay by the friction generated between the flat portions 17A and 18A and the flat portions 16B.

In the elastic member 28 illustrated in FIG. 19, the waveform springs 29 are formed at positions opposite to the front surface, the rear surface and the upper surface of the housing 14A. However, if the vibration generated in the relay body 14 can be restricted, the waveform springs 29 need not be formed at all positions opposite to all surfaces of the housing 14A. For example, the waveform springs 29 may be formed at only positions opposite to the front and the rear surfaces of the housing 14A. Alternatively, the waveform spring 29 may be formed at only a position opposite to the upper surface of the housing 14A.

Figure 22:
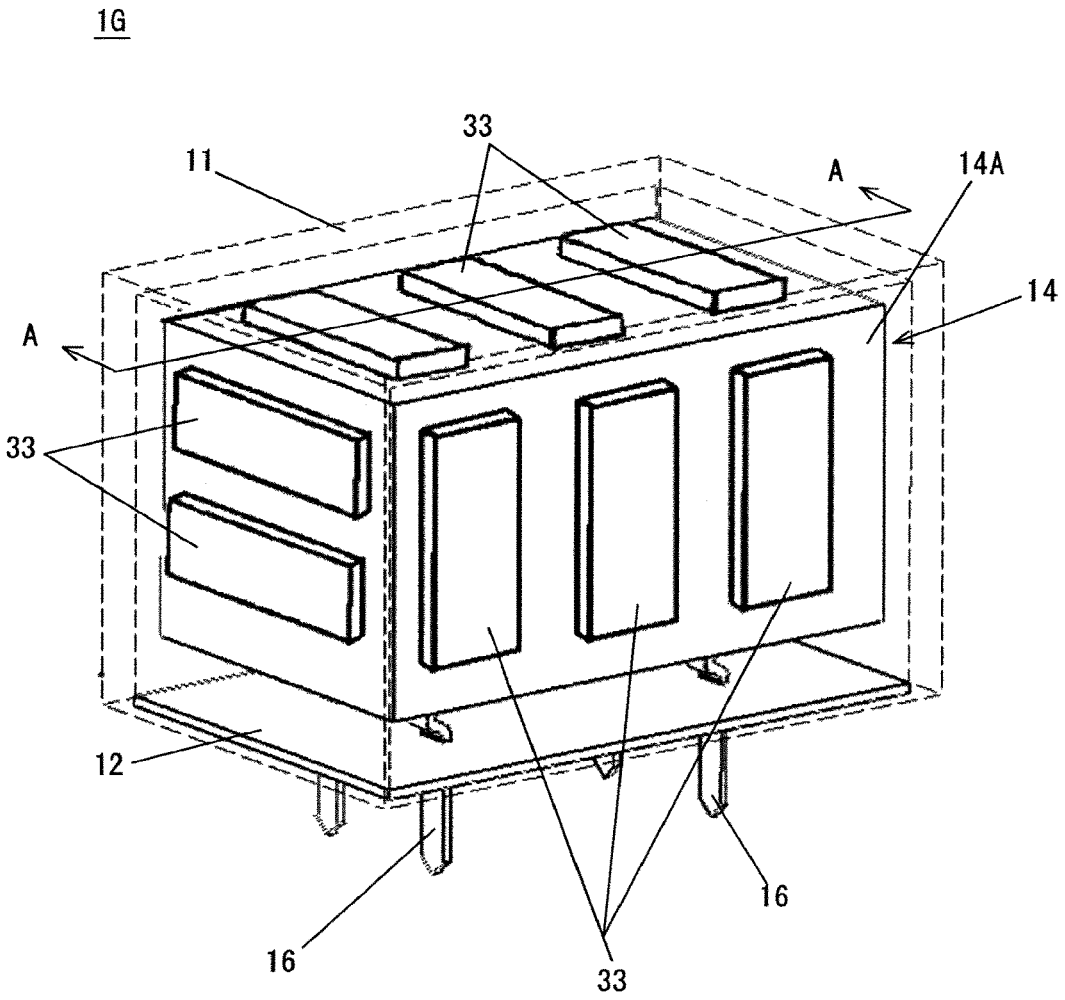
FIG. 22 is an exploded perspective view of an electromagnetic relay according to a seventh embodiment.
Figure 23:
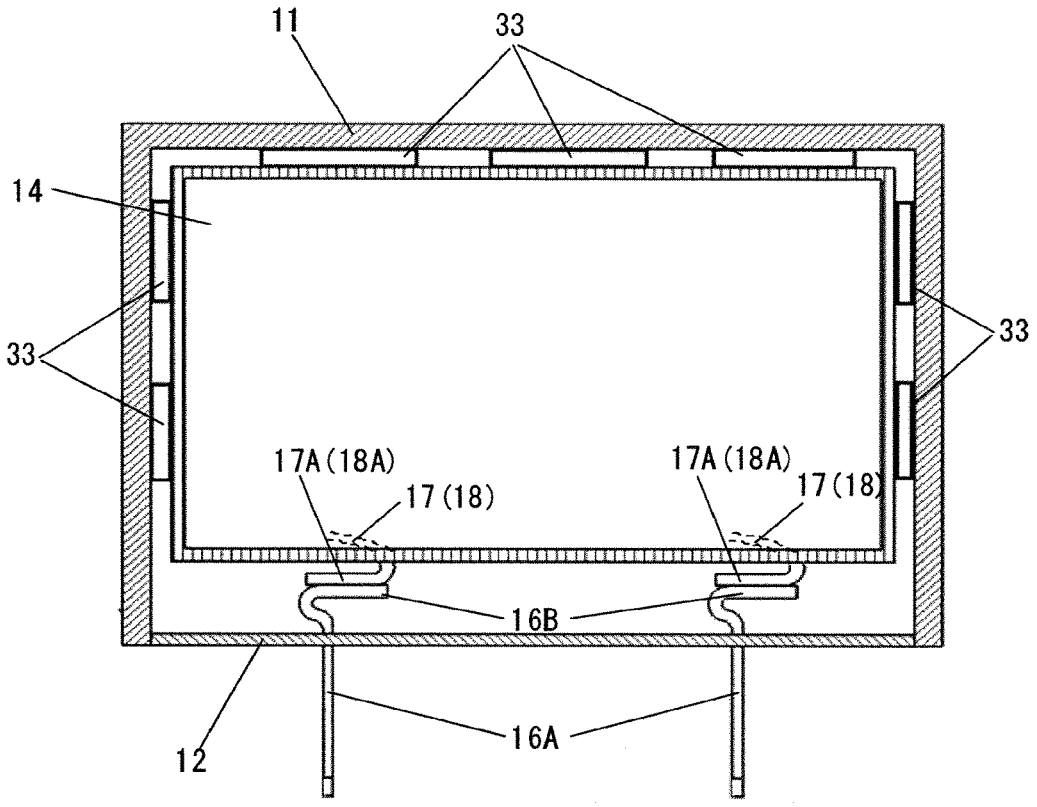
FIG. 23 is a cross-section diagram taken along line A-A in FIG. 22.

(SEVENTH EMBODIMENT) FIG. 22 is an exploded perspective view of an electromagnetic relay according to a seventh embodiment. FIG. 23 is a cross-section diagram taken along line A-A in FIG. 22. Elements corresponding to those of the first embodiment are designated by identical reference numerals, and a description thereof is omitted.

As illustrated in FIG. 22, a relay 1G according to a seventh embodiment includes the outer cover 11, the relay body 14, the base 12 and a plurality of elastic members 33. Each elastic member 33 is made of a box-like rubber or the like, for example. The elastic members 33 are stuck on the inner wall of the outer cover 11 or the surfaces of the housing 14A of the relay body 14 with an adhesive. Here, the number of elastic members 33 is not limited to the example of FIGS. 22 and 23. For example, at least one elastic member 33 may be arranged between a single surface of the housing 14A of the relay body 14 and the inner wall of the outer cover 11 opposite to the single surface.

When the outer cover 11 covers the relay body 14 to which the elastic members 33 are attached or the outer cover 11 to which the elastic members 33 are attached covers the relay body 14, a force in which the elastic members 33 press the relay body 14 presses the flat portions 17A and 18A against the flat portions 16B. At this time, it is restrained that the vibration generated in the relay body 14 propagates to the outside of the relay by the friction generated between the flat portions 17A and 18A and the flat portions 16B.

In the seventh embodiment, the elastic members 33 are provided on the front surface, the rear surface, the right surface, the left surface and the upper surface of the housing 14A or on the each inner wall of the outer cover 11. However, the elastic members 33 need not be provided on all surfaces of the housing 14A or on all the inner wall of the outer cover 11. For example, the elastic members 33 may be provided on only the right surface and the left surface of the housing 14A or only the right and left surfaces of the inner wall of the outer cover 11. Alternatively, the elastic members 33 may be provided on only the upper surface of the housing 14A or only the upper surface of the inner wall of the outer cover 11. The elastic members 33 may be provided on only the front surface and the rear surface of the housing 14A or only the front and rear surfaces of the inner wall of the outer cover 11.

Figure 24:
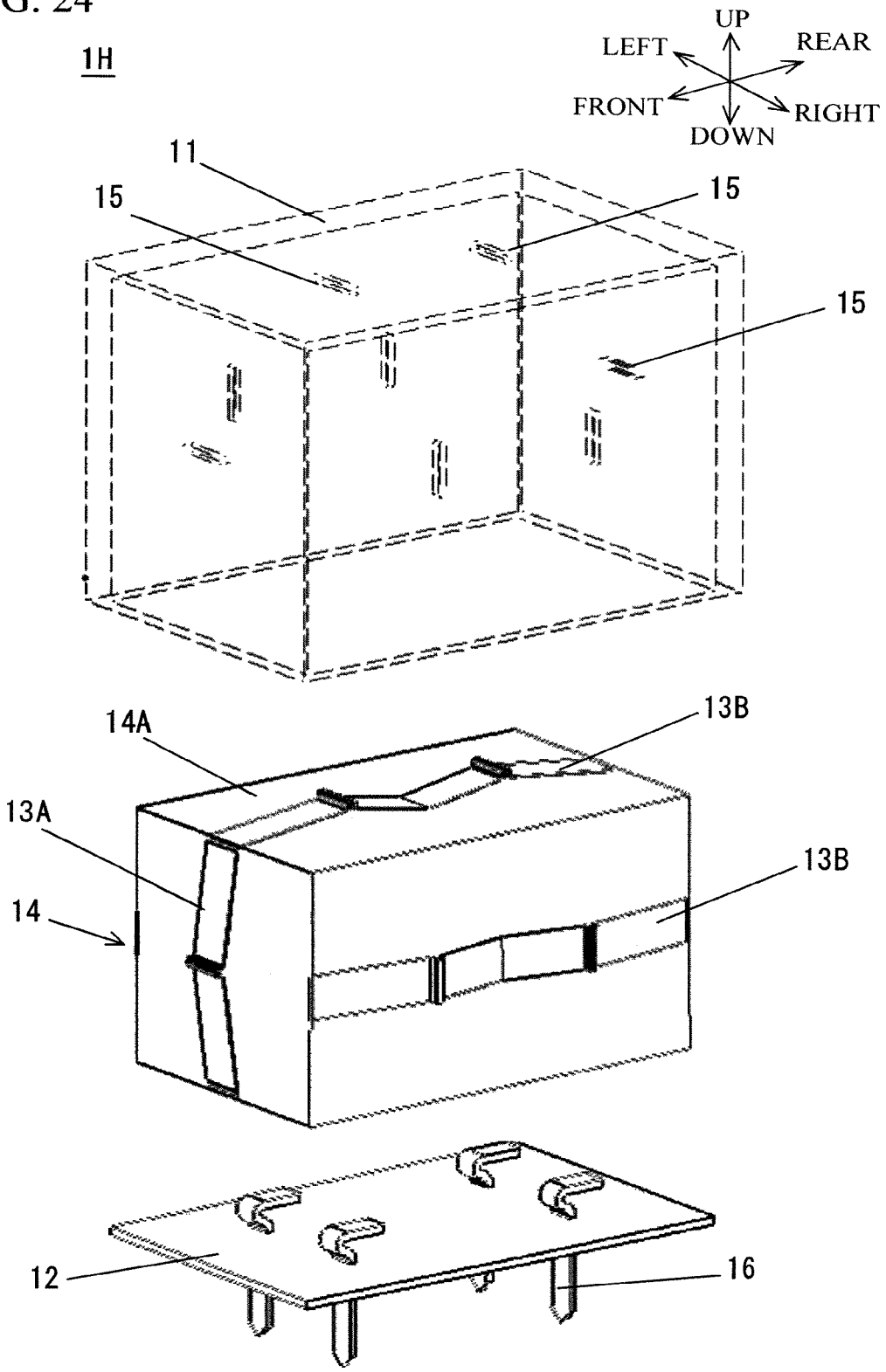
FIG. 24 is an exploded perspective view of an electromagnetic relay according to an eighth embodiment.
Figure 25:
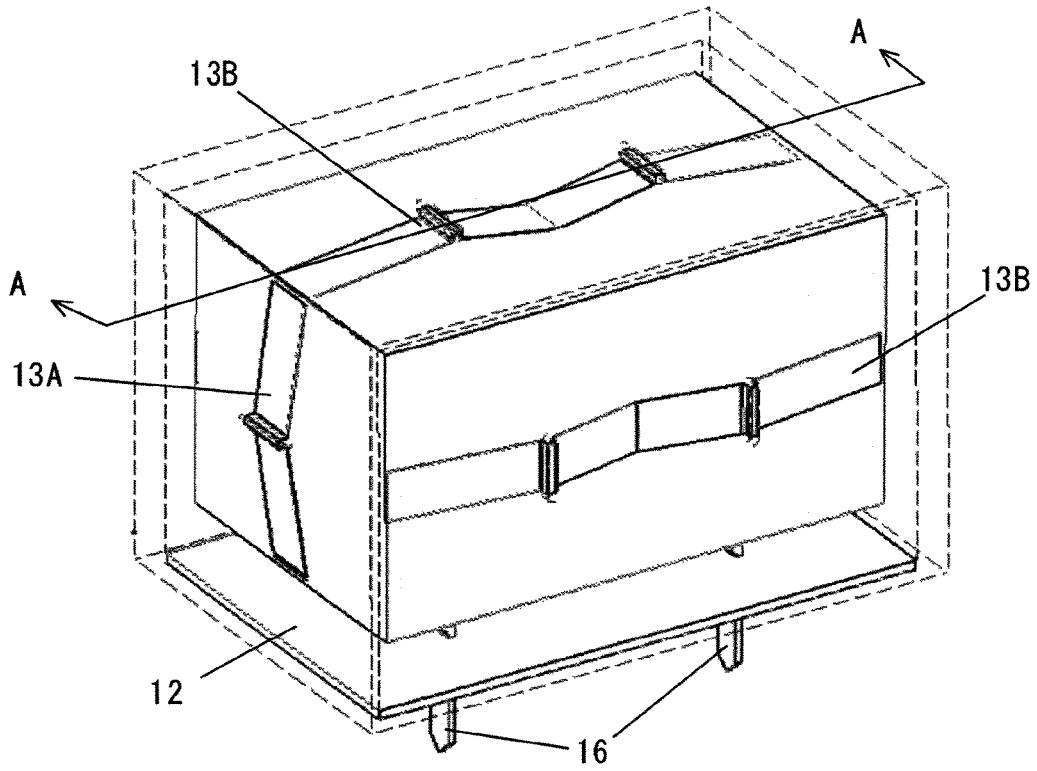
FIG. 25 is a diagram illustrating the assembly structure of the electromagnetic relay.
Figure 26:
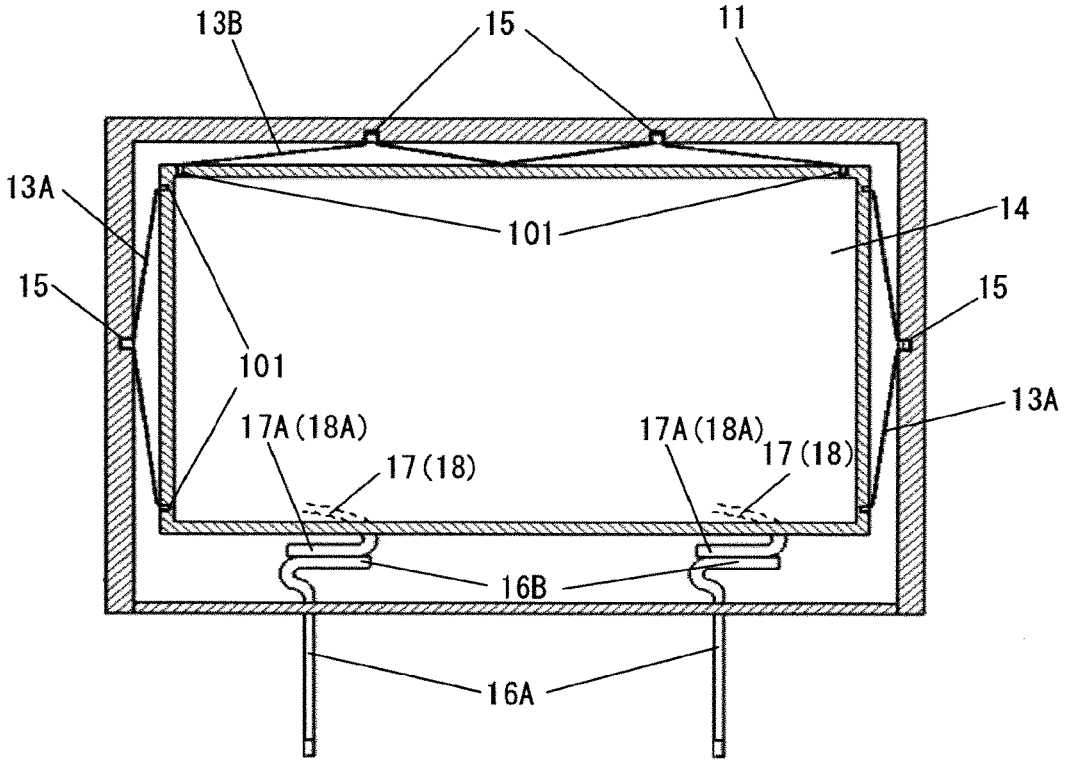
FIG. 26 is a cross-section diagram taken along line A-A in FIG. 25.

(EIGHTH EMBODIMENT) FIG. 24 is an exploded perspective view of an electromagnetic relay according to an eighth embodiment. FIG. 25 is a diagram illustrating the assembly structure of the electromagnetic relay. FIG. 26 is a cross-section diagram taken along line A-A in FIG. 25. Elements corresponding to those of the first embodiment are designated by identical reference numerals, and a description thereof is omitted. In the following, the front direction, the rear direction, the right direction, the left direction, the up direction, and the down direction are defined as illustrated in FIG. 24 for convenience of explanation.

A relay 1H according to an eighth embodiment includes the outer cover 11, the relay body 14 and the base 12, as with the relay 1 A according to the first embodiment. In the eighth embodiment, the grooves 15 are formed on the inner wall of the outer cover 11, and the grooves 101 which engage with the first engaging portions 130 of the plate springs 13A and 13B are formed on the housing 14A of the relay body 14, as illustrated in FIG. 26. In FIGS. 24 and 25, the outer cover 11 is transparent. Elastic members, the plate springs 13A and 13B in FIGS. 24 and 25, are attached to the housing 14A of the relay body 14. The shapes of the plate springs 13A and 13B are the same as the shapes illustrated in FIGS. 3A and 3B.

When the relay body 14 to which the plate springs 13A and 13B are attached is arranged on the base 12 and the outer cover 11 covers the relay body 14, the second engaging portions 131 of the plate springs 13A and 13B engage with the grooves 15 formed on the inner walls of the outer cover 11, and hence the position of the relay body 14 to the outer cover 11 is fixed. Here, the outer cover 11 is fixed on the base 12 with an adhesive. Moreover, the base 12 may be fixed to the outer cover 11 by press fit.

When a force in which the plate springs 13A and 13B press the flat portions 17A and 18A against the flat portions 16B. At this time, it is restrained that the vibration generated in the relay body 14 propagates to the outside of the relay by the friction generated between the flat portions 17A and 18A and the flat portions 16B.

In the eighth embodiment, the plate springs 13A and 13B are provided on the front surface, the rear surface, the right surface, the left surface and the upper surface of the housing 14A. However, if the vibration generated in the relay body 14 can be restricted, the plate springs 13 may be provided on only a part of the surfaces of the housing 14A. For example, the plate springs 13B may be provided on only the right and the left surfaces of the housing 14A. Alternatively, the plate springs 13B may be provided on only the upper surface of the housing 14A. Alternatively, the plate springs 13B may be provided on only the front and the rear surfaces of the housing 14A.

Figure 27:
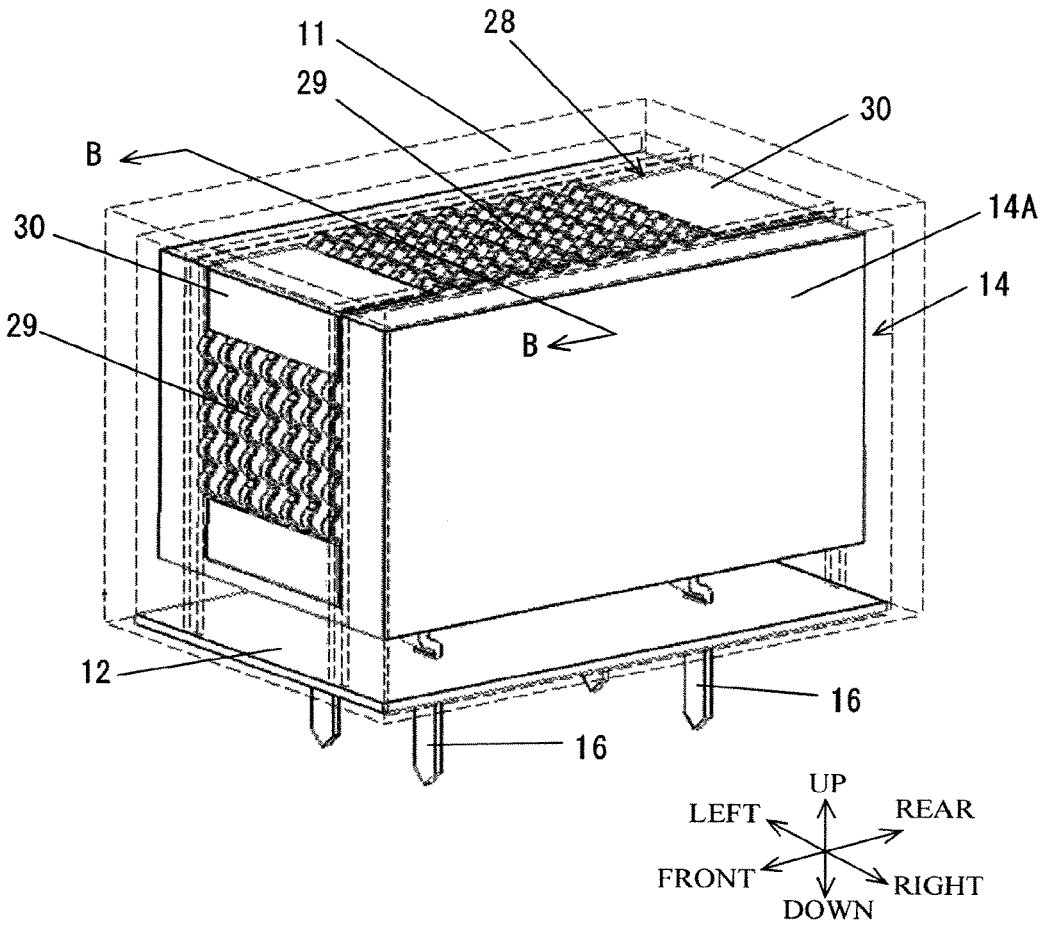
FIG. 27 is an exploded perspective view of an electromagnetic relay according to a ninth embodiment.
Figure 28:
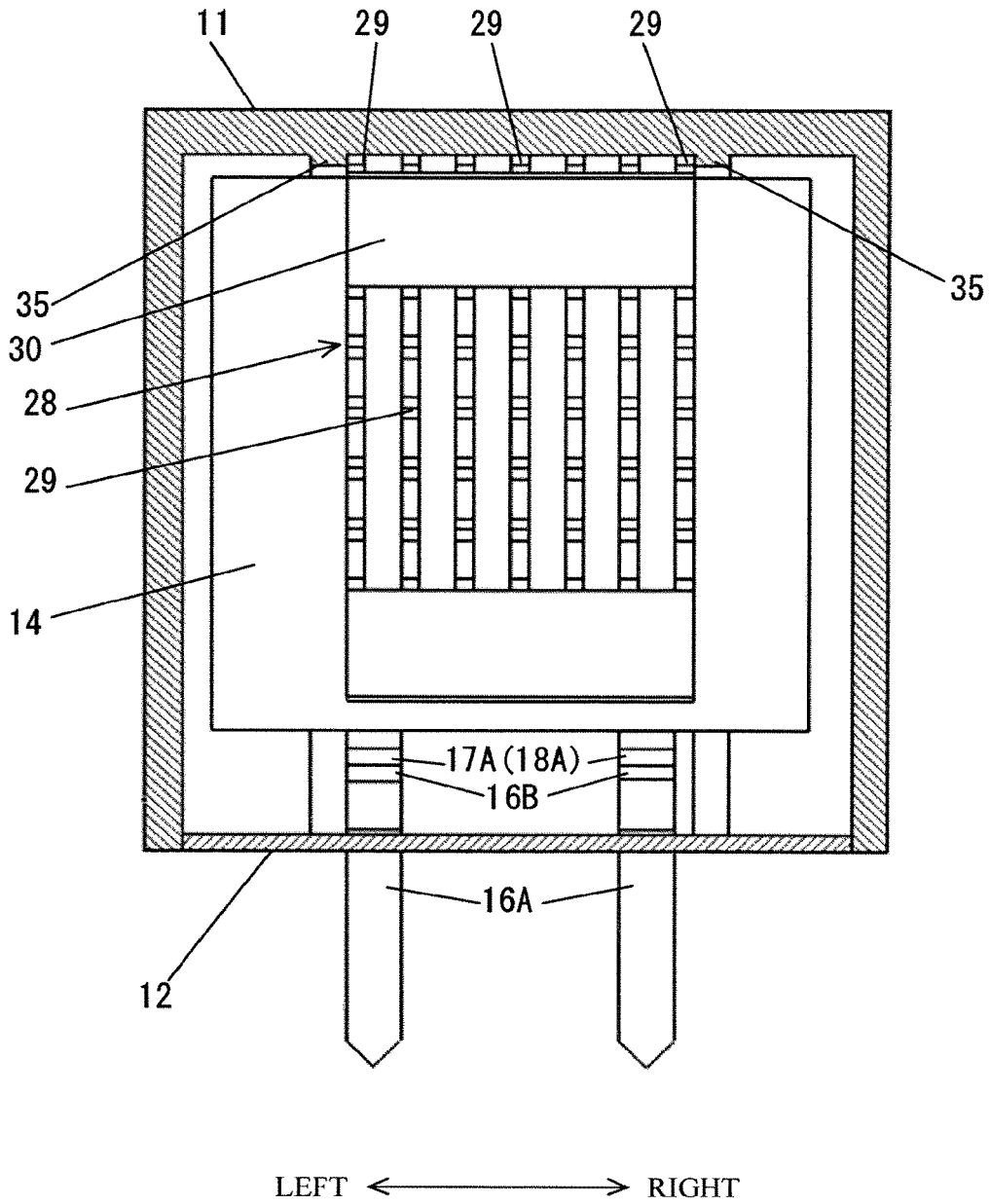
FIG. 28 is a cross-section diagram taken along line B-B in FIG. 27.

(NINTH EMBODIMENT) FIG. 27 is an exploded perspective view of an electromagnetic relay according to a ninth embodiment. FIG. 28 is a cross-section diagram taken along line B-B in FIG. 27. Elements corresponding to those of the first embodiment and the sixth embodiment are designated by identical reference numerals, and a description thereof is omitted. In the following, the front direction, the rear direction, the right direction, the left direction, the up direction, and the down direction are defined as illustrated in FIG. 27 for convenience of explanation. 100821 As illustrated in FIG. 27, a relay II according to a ninth embodiment includes the outer cover 11, the relay body 14, the base 12 and the elastic member 28.

The elastic member 28 is a substantially U-shaped plate spring, and is the integrated structure having the waveform springs 29 and the flat springs 30.

As illustrated in FIG. 28, the waveform springs 29 contact the inner wall of the outer cover 11 opposite to the upper surface of the relay body 14, and two projections 35 extending parallel are formed on the inner wall of the outer cover 11 opposite to the upper surface of the relay body 14 to prevent the deviation of the elastic member 28 in a width direction. The waveform springs 29 are arranged between the projections 35. Here, the projections 35 may be formed on the inner wall of the outer cover 11 opposite to the side surfaces of the relay body 14.

When the outer cover 11 covers the relay body 14 to which the elastic member 28 is attached, the waveform springs 29 enter between the projections 35.

Then, a force in which the elastic member 28 presses the relay body 14 presses the coil terminals 17 and the contact terminals 18 of the relay body 14 against the external terminals 16 of the base 12. At this time, it is restrained that the vibration generated in the relay body 14 propagates to the outside of the relay by the friction generated between the flat portions 17A and 18A and the flat portions 16B. Moreover, the projections 35 prevent the deviation of the elastic member 28 in the width direction.

In the first to the ninth embodiments, the plate spring, the rubber or the elastomer is used as the elastic member, but a coil spring may be used as the elastic member.

As described above, according to the first to the ninth embodiments, the electromagnetic relay (1A-1I) includes: the relay body 14 that includes the coil terminals 17 and the contact terminals 18; the base 12 that includes the external terminals 16 which contact the coil terminals 17 and the contact terminals 18 and support the relay body 14; the outer cover 11 that covers the relay body 14 along with the base 12; and the elastic member (the plate springs 13A and 13B, the plate spring 21 or the elastic member 26, 27, 28 or 33) that is attached between the relay body 14 and the outer cover 11. The force in which the elastic member presses the relay body 14 presses the coil terminals 17 and the contact terminals 18 of the relay body 14 against the external terminals 16 of the base 12. Therefore, it can be restrained that the vibration generated in the relay body 14 propagates to the outside of the relay by the friction generated between the external terminals 16, and the coil terminals 17 and the contact terminals 18.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. An elechtromagnetic relay comprising:

a relay body that includes a first terminal;

a base that includes a second terminal which contacts the first terminal and supports the relay body;

an outer cover that covers the relay body; and plate springs that are attached between the relay body and the outer cover and generate a force that presses the first terminal against the second terminal, wherein the first terminal includes a first flat portion in parallel with a bottom surface of the relay body, and the second terminal includes a second flat portion that is in parallel with the bottom surface of the relay body, contacts the first flat portion and supports the relay body, and wherein the plate springs press on surfaces of the relay body other than a surface thereof on which the first terminal is provided.

2. The electromagnetic relay as claimed in claim 1, wherein both ends of each of the plate springs include first engaging portions which engage with one of an inner wall of the outer cover and a housing of the relay body, and a middle portion of each of the plate springs includes a second engaging portion which engages with the other of the inner wall of the outer cover and the housing of the relay body.

3. The electromagnetic relay as claimed in claim 1, wherein an inner wall of the outer cover includes receiving portions for attaching the elastic member, both ends of the elastic member include bending portions to be fitted into the receiving portions, a middle portion of the elastic member includes a third flat portion which curves so as to contact a housing of the relay body when the elastic member is attached to the receiving portions, and the housing of the relay body includes a fitted portion into the curved third flat portion is fitted.

4. The electromagnetic relay as claimed in claim 1, wherein the outer cover includes a through-hole at a surface thereof, and the elastic member is inserted from the through-hole.

5. The electromagnetic relay as claimed in claim 1, wherein the elastic member includes a waveform portion that contacts a housing of the relay body and an inner wall of the outer cover, a fourth flat portion that has a shape along the housing of the relay body, and a projection that engages with a groove formed on the housing of the relay body.

6. An electromagnetic relay, comprising:

a relay body that includes a first end, a second end, sides therebetween and a first terminal extending from the second end and having a surface;

a base that includes a second terminal with a surface which directly contacts the surface of the first terminal and supports the relay body;

an outer cover that covers the relay body and includes a first end corresponding to the first end of the relay body, an open second end, opposite the first end, that receives the base, and sides between the first and second ends of the outer cover at the sides of the relay body; and plate springs that are attached to and extend between surfaces of the relay body, except the second end, and surfaces of the outer cover, except the open second end, to generate a force that presses the surface of the first terminal directly against the surface of the second terminal.

7. The electromagnetic relay as claimed in claim 6, wherein both ends of each of the plate springs include first engaging portions which engage with one of an inner wall of the outer cover and an outer wall of the relay body, and an intermediate portion of each of the plate springs includes at least one second engaging portion which engages with the other of the inner wall of the outer cover outer wall of the relay body.

* * * * *